US005932387A

United States Patent [19]

Yamamoto et al.

[11] Patent Number: 5,932,387

[45] Date of Patent: Aug. 3, 1999

[54] CHARGED MEMBER FOR ELECTROSTATIC DEVELOPMENT AND SLEEVE FOR ELECTROSTATIC DEVELOPMENT

[75] Inventors: Yasuo Yamamoto; Takeshi Agata; Masato Mikami; Kazuhiko Yanagida; Suk Kim, all of Minami-Ashigara, Japan

[73] Assignee: Fuji Xerox Co., Ltd., Tokyo, Japan

[21] Appl. No.: 08/907,002

[22] Filed: Aug. 6, 1997

[30] Foreign Application Priority Data

Aug. 9, 1996 [JP] Japan ..... 8-211729
May 9, 1997 [JP] Japan ..... 9-119854

[51] Int. Cl.[6] ..... G03G 9/113

[52] U.S. Cl. ..... 430/108; 428/407

[58] Field of Search ..... 430/108, 138; 428/402.24, 404, 406, 407

[56] References Cited

U.S. PATENT DOCUMENTS 4,965,159 10/1990 Kohno et al. ..... 430/108
5,071,725 12/1991 Kubo et al. ..... 430/108
5,272,038 12/1993 Matsubara et al. ..... 430/108

*Primary Examiner*—John Goodrow
*Attorney, Agent, or Firm*—Oliff & Berridge, PLC

[57] ABSTRACT

The present invention provides a charged member which has no reduction in the amount of electrostatic charge at high temperature and high humidity and no extreme increase in the amount of electrostatic charge at low temperature and low humidity, improves the adhesion force between a charged member and a coating layer, prevents deterioration of developer through peeling of the coating layer. It provides excellent durability without deterioration of toner through adhering of a toner to the carrier. More particularly, a carrier for electrophotography and a sleeve for electrostatic development which use as a coating material a high-molecular compound containing as an essential component the first monomer represented by the following general formula (1) and/or (2), the second monomer represented by the following general formula (3) and/or (4) and a coupling agent containing a vinyl group are provided.

21 Claims, 1 Drawing Sheet

CHARGED MEMBER FOR ELECTROSTATIC DEVELOPMENT AND SLEEVE FOR ELECTROSTATIC DEVELOPMENT

BACKGROUND OF THE INVENTION

1. Field of the Invention

The present invention relates to a carrier for electrostatic development (a carrier for electrophotography) used for electrostatic latent image in electrophotography and electrostatic recording and charged member such as a sleeve and coating member for electrostatic development and the like, as well as an electrostatic latent image developer utilizing the coating member.

2. Description of the Related Art

A method for visualizing an image information via electrostatic image such as electrophotography has been used in various fields. In electrophotography, an electrostatic latent image is formed on a photoreceptor in electrostatic charging and exposure steps, the electrostatic latent image is developed with a developer containing a toner, and is visualized via transfer and fixing steps. Examples of the developer used herein are a two-component developer composed of a toner and a carrier, and a one-component developer such as a magnetic carrier which is used alone. The two-component developer is now widely employed due to good controlling properties since a carrier performs functions such as stirring, transportation and electrostatically charging of a developer, which are separated into each component in the developer.

In addition, as a developing method, a cascade method or the like was conventionally used, while a magnetic brush method is predominant at present, where a magnetic roll is utilized as a developer conveying carrier. A conductive magnetic brush (CMB) development utilizing a conductive carrier and an insulating magnetic brush (IMB) development utilizing an insulating carrier are known as a two-component magnetic brush development. Among them, the CMB development has characteristics such that charge is injected through a developing roll due to lower resistance of a carrier, carriers in the vicinity of a photoreceptor plays a role as a developing electrode to increase the effective developing electric field and, as a result, transfer of a toner is sufficiently performed, resulting in the excellent productivity of a solid image. On the contrary, there is a problem that image defects are easily produced, such as a white line called brush mark caused by charge injection through a developing roll and the like and transfer of a carrier to a photoreceptor called carrier-over and the like.

Recently, coloring technique has rapidly progressed, and higher level has been required on color image quality. In particular, solid image is important in the color image quality. Therefore, the CMB carrier having improved performance including durability is strongly desired. Japanese Patent Application Publication (JP-B) No. 7-120086 discloses a carrier which abruptly changes in its resistance at a certain electric field by coating a core material (hereinafter referred to as "carrier core" or "core") having relatively low resistance with a resin having higher resistance, and thus becomes higher resistance at a lower electric field and lower resistance at higher electric field. It is described for the carrier that excellent black solid print is obtained without carrier-over at a non-latent image part since higher electric field is applied to a latent image part and lower electric field is applied to a non-latent image part. However, it is presumed that, from the description in Examples and Actions in the specification of the invention (JP-B No. 7-120086), the thickness of a resin coating layer is significantly small, and a low resistive core is partially exposed. It is considered that such a structure makes the carrier lower resistance at higher electric field. In fact, as described in Comparative Examples below, in case where the core is completely coated with the resin and the thickness of a resin coating layer is large, the carrier is higher resistance even at higher electric field to provide no good solid image. In a partial coating where a part of such a low resistive core is exposed, charge is easy to move through an exposed surface, whereby brush mark is easy to be produced at a latent image part.

In addition, Japanese Patent Application Laid-Open (JP. A) Nos. 61-107257 and 61-13059 disclosed ferrite having relatively low resistance and having irregularity on the surface based on primary particles. It is described that leakage between different polar charges is suppressed to prevent brush mark due to such fine irregularity. However, there is a problem that, because of fine irregularity on the carrier surface, an area in contact with a toner is increased, and thus a toner tends to adhere to the carrier with decreasing an ability of the carrier to be charged over a period of time. In addition, JP-A No. 61-161157 disclosed an invention defined by a ratio of resistance of a carrier core and that of a carrier obtained by coating a resin thereon. It is shown therein that such definition satisfies all the requirement such as degree, solid image concentration and fine line productivity at a time. However, the invention provides insufficient effect in terms of preventing image defects for a color image.

On the other hand, there are a variety of properties required for a carrier coated with a resin, and it is necessary to impart suitable electrostatically charging property (the amount and distribution of electrostatic charge) to a toner and the suitable electrostaticall charging property of a toner is required to be maintained over a longer period of time. Properties such as resistance to impact and resistance to abrasion are required for the carrier. In particular, it is important that electrostaticall charging property of a toner is not sensitive to changes in enviromental condition such as humidity, temperature and the like. Thus a variety of carriers coated with a resin have been proposed.

More particularly, there are proposed the use of a copolymer of nitrogen containing alkyl (meth)acrylate and vinyl monomer, and a copolymer of fluorinated alkyl (meth) acrylate and vinyl monomer (see JP-A Nos. 64-35526 and 2-24670).

In addition, it is disclosed that the surface of a carrier core was coated with a copolymer of a nitrogen-containing monomer and a fluorinated monomer to obtain a carrier coated with a resin having relatively long life (see JP-B No. 3-23909). However, it is difficult to obtain uniform composition because of difficulty in copolymerizing monomers or phase separation. Furthermore, since the composition has a certain wide distribution, deviation of properties is caused between coated portions and un-coated portions to unsufficiently provide resistance to impact and resistance to staining for a toner. In particular, there was a problem that, since the reduced amount of electrostatic charge at high temperature and high humidity and the extremely increased amount of electrostatic charge at low temperature and low humidity make stability of electrostatically charging property of a developer lower, the carrier did not withstand over long-time use because of fog in an image and unevenness in image concentration being occurred.

In addition, a carrier having low surface energy has been disclosed, which is coated with a coating layer containing a silicone resin. Examples may include a carrier having the surface coated with a mixture of an unsaturated silicone resin and an organosilicone, silanol and the like with styrene/acrylic resin (U.S. Pat. No. 3,562,533), a carrier having the surface coated with polyphenylene resin and organosilicone terpolymer resin (U.S. Pat. No. 3,487,127), a carrier having the surface coated with styrene/acrylate or methacrylate resin and organosilane, silanol, siloxane and the like (U.S. Pat. No. 3,627,522), a carrier coated with a coating layer containing a silicone resin and a nitrogen-containing resin having electrostatically charging property (JP-A No. 55-127567), a carrier coated with a resin-modified silicone resin (JP-A No. 55-157751), and a carrier coated with a mixture of a copolymer of acrylic ester and vinyl silane and a copolymer of acrylic ester containing fluorine-containing alkyl group and acrylic ester at a specified ratio (JP-A No. 2-34670) and the like.

A toner does not tend to adhere to a carrier coated with a silicone resin toner or a coating layer containing a silicone resin due to low surface energy thereof, and adhesive force to a charged member is not strong. Therefore, a coating layer is peeled off from an adhesion interface because of friction force, impact force, shear force and the like generated in a developing machine. Electrostatically charging property and electrical resistance are changed, and thus image quality is deteriorated. This tendency is remarkable at a higher copying rate of a copier and an increased stress applied to a charged member. In addition, also in a case where an organic pigment, a dye or the like is utilized as a colorant in a color toner, the toner tends to adhere to a carrier. Further, electrostaticall charging property and electrical resistance are changed, and thus image quality is deteriorated at a higher copying rate of a copier and an increased stress applied to a charged member. The phrase "the toner adhering to the carrier" or the term "spentation" used herein refers to phenomenon in which firm adherence or fusion of a toner and/or an additive, colorant and the like to the surface of charged member occurs because of mechanical collision such as collision and friction between toner particles, or collision and friction between toner particles and a developing machine, as well as exothermic heat caused by friction.

In addition, in a carrier coated with a mixture of acrylic ester containing fluorine-containing group and a copolymer with acrylic ester at a specified ratio, since resins having different surface tension from each other are mixed in a solution, a solution is evaporated during coating to a carrier. As an amount of resin solid grows larger on the surface, a coating is formed such that the coating has a domain structure (sea-island structure) and in which phase separation is caused, leading to a problem on resistance to impact and adhesive property.

Therefore, there has been a need for a carrier and the like which suppresses "spentation", enhances adhesive interface strength of a coating layer and resin strength of a coating layer, and has stability of electrostatically charging for long-time use.

SUMMARY OF THE INVENTION

An object of the present invention is to provide a charged member which has no reduction in the amount of electrostatic charge at high temperature and high humidity and no extreme increase in the amount of electrostatic charge at low temperature and low humidity, enhances adhesive force between a charged member and a coating layer, prevent deterioration of a developer through peeling of a coating layer, and produces no deterioration of a toner through adhering of a toner to a carrier, and has excellent durability, and to provide a coating member for the charged member.

Further, other object of the present invention is to provide a charged member for electrostatic development which is suitable for use together with a color toner, such as a carrier for electrostatic development and a sleeve for electrostatic development.

The present invention is an a coating member for a charged member, which comprises the first monomer component(s) represented by the general formula (1) and/or (2) below and the second monomer component(s) represented by the general formula (3) and/or (4) below. A coating member for a charged member further comprising a coupling agent containing a vinyl group. In particular, the coupling agent is preferably a silane coupling agent.

The object is also attained by a carrier for electrophotography and/or a sleeve for electrostatic development which employs the coating member for a charged member as a coating material. A charged member for electrostatic development, which comprises a substrate and a coating layer which coats the substrate, wherein the coating layer comprises the first monomer component(s) represented by the general formula (1) and/or (2) below; the second monomer component(s) represented by the chemical formula (3) and/or (4) below, and a coupling agent containing a vinyl group.

In particular, when the substrate is a carrier core material, the above charged member for electrostatic development corresponds to a carrier for electrophotography. In addition, when the substrate is a conducting substrate, the charged member for electrostatic development corresponds to a sleeve for electrostatic development.

The coupling component is preferably a silane coupling agent.

It is preferable that the material of the coating layer is selected from the group consisting of random copolymer, graft copolymer, block copolymer and group transfer copolymer, which copolymer or polymer comprises the first monomer component(s) and the second monomer component(s).

(1)

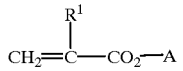

In the general formula (1), $R^1$ is a hydrogen atom or a methyl group, and

A is $-(CH_2)_{n1}NR^2R^3$ (each of $R^2$ and $R^3$ is independently an alkyl group or an aryl group, and $n_1$ is an integer of 0 to 10).

(2)

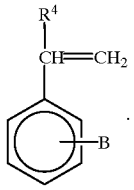

In the general formula (2), $R^4$ is a hydrogen atom or a methyl group, and

B is $-(CH_2)_{n3}-NR^5R^6$ (each of $R^5$ and $R^6$ is independently an alkyl group or an aryl group, $n_2$ is an integer of 0 to 10).

(3)

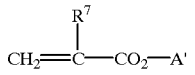

In the general formula (3), $R^7$ is a hydrogen atom or a methyl group, and

A' is $—(CH_2)_{n3}—(CF_2)_m—CF_3$ or $—(CH_2)_{n3}(CF_2)_m—CF(CF_3)_2$ ($n_3$ is an integer of 0 to 0 and m is an integer of 1 to 10).

(4)

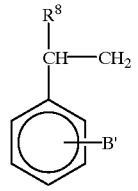

In the general formula (4), $R^8$ is a hydrogen atom or a methyl group, and

B' is a fluorine atom, a trifluoromethyl group, $—Z—(CH_2)_{n4}—(CF_2)_m—CF_3$ or $—Z—(CH_2)_{n4}(CF_2)_m—CF(CF_3)_2$ ($n_4$ is an integer of 0 to 8, m is an integer of 1 to 10, and Z is an oxygen atom, a carbonyl group or an acid amide group).

The present invention defined above can remarkably improve stability of electrostatically charging, stability in circumstance and image quality maintaining property of a charged member such as a carrier, a sleeve for electrostatic development and the like. Also, the present invention can afford good image quality without unevenness in image concentration and background staining.

In addition, the other object of the present invention is to provide a carrier for electrostatic development having a very long life, which can overcome the above problem, on which a resin coating having chemical-structurally uniform composition can be formed, which has no reduction in the amount of electrostatic charge at high temperature and high humidity and no extreme increase in the amount of electrostatic charge at low temperature and low humidity. The carrier is excellent in resistance to impact and resistance to staining for a toner, in particular, a carrier for electrophotography which causes no image defects such as brush mark and carrier-over in a color image and can afford good solid image, and additionally has durability, as well as an electrostatic latent image developer using the same.

The present inventors found that, in order to obtain good solid image by preventing image defects such as brush mark and carrier-over, resistance of a carrier is required to be in a desired range and, in order to comply therewith, it is important that resistance of a carrier core is less than a certain value and resistance of a resin coating layer is in a certain range. On the other hand, it was found that, in order to maintain stable image quality for a long period of time, the composition and the structure of a resin in a coating layer are important.

That is, the present invention is a carrier for electrophotography having a resin coating layer containing conductive powders on a core material, said carrier for electrophotography in which said core material has a dynamic electrical resistance of not greater than 1 Ω cm under electric field of $10^4$ V/cm in the state of a magnetic brush, a resin coating layer has electrical resistance in a range of 10 to $1\times10^8$ Ω cm, and a resin in the resin coating layer is random copolymer, block copolymer or graft copolymer copolymerized with a monomer represented by the general formula (I) and/or (II) below and a monomer represented by the general formula (III) and/or (IV) below, as well as an electrostatic latent image developer utilizing the carrier.

(I)

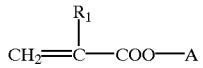

In the general formula (I), $R_1$ represents a hydrogen atom or a methyl group, A represents $—(CH_2)_{n1}—NR_2R_3$, each of $R_1$ and $R_3$ represents independently an alkyl group or an aryl group, and $n_1$ represents an integer of 0 to 10.

(II)

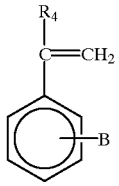

In the general formula (II), $R_4$ represents a hydrogen atom or a methyl group, B represents $—(CH_2)_{n2}—NR_5R_6$, each of $R_5$ and $R_6$ represents independently an alkyl group or an aryl group, and $n_3$ represents an integer of 0 to 10.

(III)

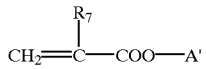

In the general formula (III), $R_7$ represents a hydrogen atom or a methyl group, A' represents $(CH_2)_{n3}—(CF_2)_m—CF_3$ or $—(CH_2)_{n3}—(CF_2)_m CF(CF_3)_2$, $n_3$ represents an integer of 0 to 12, and m represents an integer of 1 to 12.

(IV)

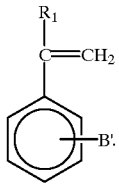

In the general formula (IV), $R_R$ represents a hydrogen atom or a methyl group. B' represents $—Z—(CH_2)_{n1}—(CF_2)_m CF_3$ or $—Z—(CH_2)_{n6}—(CF_3)_m—CF(CF_3)_2$, $n_4$ represents an integer of 0 to 8, m represents an integer of 1 to 10, and Z represents an oxygen atom, a carbonyl or an acid amide.

It is suitable that a resin in the resin coating layer is a copolymer further copolymerizing the third monomer component(s) represented by the following general formula (V) and/or (VI) in addition to the first and the second monomer components.

(V)

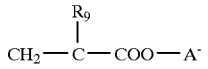

In the general formula (V), $R_9$ represents a hydrogen or a methyl group, A" represents a hydrogen, an alkyl group, a cycloalkyl group, an aryl group, an allyl group, an alkoxyalkylsilyl group, or an epoxyalkyl group.

(VI)

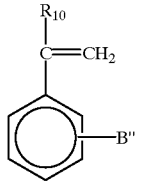

In the general formula (VI), $R_{10}$ represents a hydrogen or a methyl group. R" represents a hydrogen, an alkyl group, a cycloalkyl group, or an aryl group.

It is preferable that a resin in the resin coating layer is a copolymer further copolymerized with a cross linking monomer.

It is preferable that the thickness of the resin coating layer ranges from 0.3 to 5 μm.

It is preferable that volume average particle size of the core material ranges from 10 to 100 μm.

It is preferable that the core material is ferrite or a core material in which resin powders are dispersed in a thermoplastic or a thermosetting resin.

It is preferable that electrical resistance of the conducting powders is not greater than $10^6$ Ω cm, and that the conducting powders are contained at 2 to 40% by volume relative to the resin coating layer.

Further, it is preferable that an electrostatic latent image developer essentially consists of the carrier for electrophotography as well as a toner particle comprising a binding resin and a colorant.

According to the other aspect of the present invention, there can be provided a carrier for electrostatic development having very long life, which has no reduction in the amount of electrostatic charge at high temperature and high humidity and no extreme increase in the amount of electrostatic charge at low temperature and low humidity, and has excellent resistance to impact and resistance to staining for a toner, an electronic latent image developer and an image forming method using the same, in particular, a carrier for electrophotography, an electrostatic latent image developer and an image forming method which can afford good solid image and durability without image defects such as brush mark and carrier-over in a color image.

DESCRIPTION OF THE PREFERRED EMBODIMENTS

Figure 1:
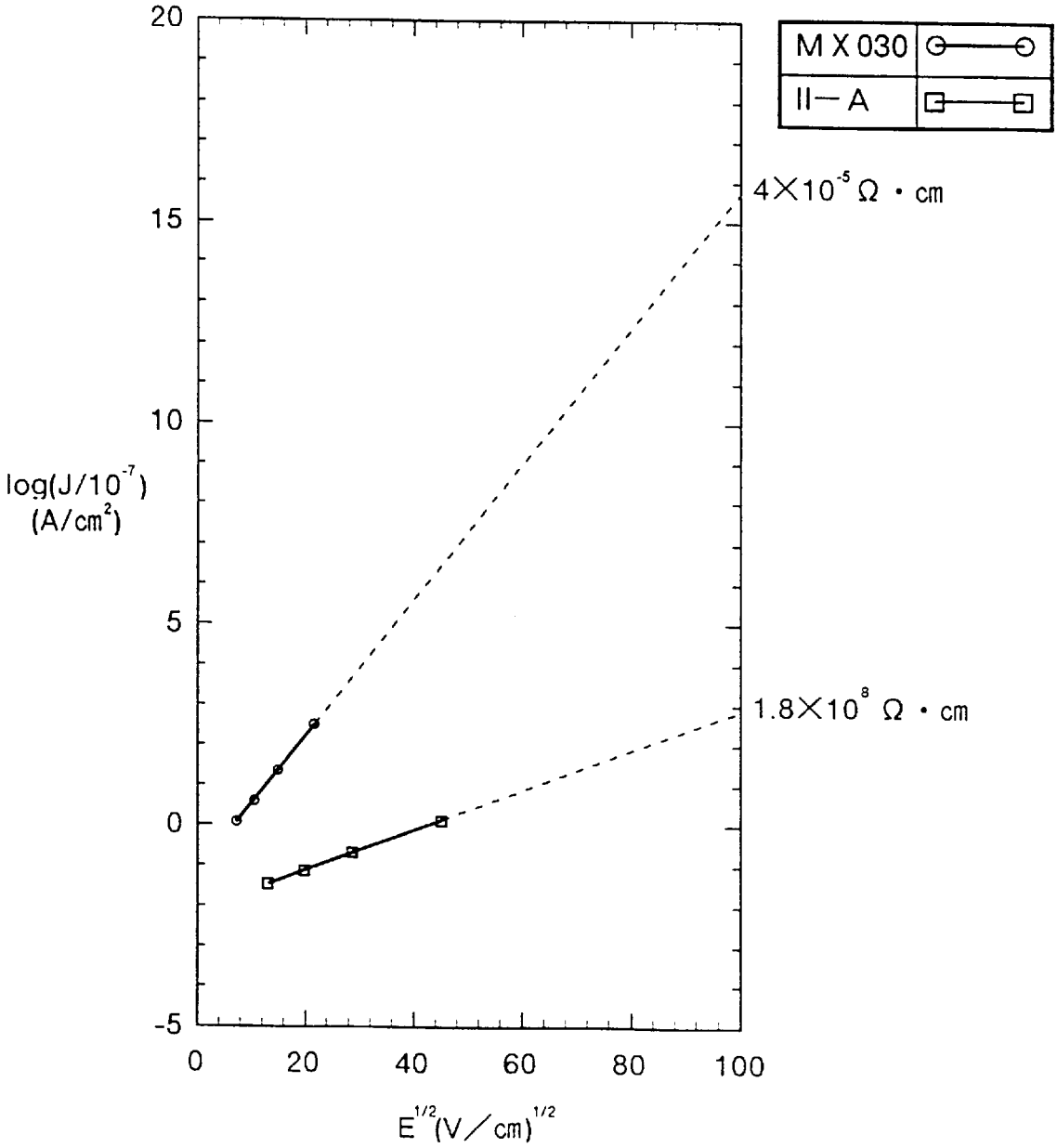
FIG. 1 shows the results of determination of resistance using a carrier in Example 12 in the form of a magnetic brush, and shows a relationship between current density J and applied electric field E. Resistance value is estimated when extrapolated towards electric field of $10^4$ V/cm.

The present invention is described in more detail below.

A charged member for a electrostatic development in the present invention means a member which will be charged in an electrostatic developing method. Examples of the member may include a carrier for electrophotography, a sleeve for electrostatic development, and blade for electrostatic development.

Conventional materials used as a core material such as sand, glass, metal and the like may be used as a material for a carrier core material in the present invention. In particular, examples which are strongly magnetized by magnetic field, in the direction thereof, may include ferrite and magnetite as well as a metal exhibiting ferromagnetism such as iron, cobalt, nickel and the like, or an alloy or a compound containing these metals, an alloy which exhibits ferromagnetism by suitable heat-treatment without ferromagnetic element, for example, an alloy called Heusler alloy containing manganese and copper such as manganese-copper-aluminum, manganese copper-tin and the like, or chromium dioxide and others.

More preferably, magnetic substance-dispersed carriers in which magnetic substance powders are dispersed in a binding resin may be used. More preferably, for example, phenol resin-dispersed magnetic core material particles described in JP-A-No. 2 220060, and resin-dispersed magnetic core material particles having internal cross-linked structure such as polyurethane resin-dispersed magnetic core material particles described in JP-A No. 8-6306 may be used. Average particle size of these carrier core materials ranges from 10 to 100 μm, preferably 20 to 75 μm. A centrifugation-type classifier, an inertia-format classifier or a sieve may be used to adjust the desired particle size distribution. In addition, suitable magnetic force may be applied to the carrier by using the known methods to obtain desired magnetic force distribution.

The coating layer is applied to the surface of the core material. Alternatively, in order to improve the adhesive interface, an intermediate layer comprising a silane coupling agent, a zirconium coupling agent, an aluminium coupling agent, a titanate coupling agent or the like may be provided between the core material and the coating layer. Examples of the silane coupling agent used in the intermediate layer include β-(3,4-epoxycyclohexyl)ethyltrimethoxysilane, γ-glycidoxypropyltrimethoxysilane, γ-mercaptopropyltrimethoxysilane, γ-minopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, γ-chloropropyltrimethoxysilane, vinyltrimethoxysilane, vinyltriethoxysilane, tris-(β-methoxyethoxy)vinylsilane, vinyltriacetoxysilane, γ-methacryloxypropyltrimethoxysilane, and β-mercaptoethyltrimethoxysilane and the like.

Examples of the zirconium coupling agent include acetylacetone zirconium butoxide, ethyl acetoacetate zirconium butoxide, zirconium methacrylate butoxide, zirconium stearate butoxide, zirconium isostearate butoxide and the like.

Examples of the aluminium coupling agent include acetoalkoxyaluminium diisopropylate, monobutoxyaluminium diisopropylate and the like.

Examples of the titanate coupling agent include isopropyltriisostearoyl titanate, isopropyltridodecylbenzenesulfonyl titanate, isopropyltris(dioctylpyrophosphate) titanate, tetraisopropylbis(dioetylphosphite) titanate, tetraoctylbis(ditridecylphosphite) titanate, tetra(2,2 diallyloxymethyl-1-butyl)bis(di-tridecyl)phosphite titanate, bis(dioctylpyrophosphate)oxyacetate titanate, bis (dioctylpyrophosphate)ethylene titanate, isopropyltrioctanoyl titanate, isopropyldimethacrylisostearoyl titanate, isopropyltri(dioctylphosphate) titanate, isopropyltricumylphenyl titanate, isopropyltri(N-aminoethyl.aminoethyl) titanate, dicumylphenyloxyacetate titanate, diisostearoylethylene titanate, isopropyltristearoyl titanate, isopropylmethacrylisostearoyl titanate and the like.

Upon the use of these coupling agents, they may be used alone or in a combination thereof. In addition, in the intermediate layer, a modified silicone oil and the like may be used alone or together as necessary.

Further, specific examples of the first monomer represented by the general formula (1) and/or (2) and the second monomer represented by the general formula (3) and/or (4) used in the coating layer are shown in Tables 1 to 4, but are not limited thereto. In addition, for the first monomer, both of the general formulas (1) and (2) may be used, or either of them may be used alone. In addition, for the second monomer, both of the general formulas (3) and (4) may be used, or either of them may be used alone.

Embodiments of the monomer represented by the general formula (1) are shown in Table 1.

TABLE 1

| Compound No. | $R^1$ | $R^2$ | $R^3$ | n1 |
|---|---|---|---|---|
| 1 | H | $CH_3$ | $CH_3$ | 0 |
| 2 | $CH_3$ | $CH_3$ | $CH_3$ | 2 |
| 3 | H | $C_2H_5$ | $CH_3$ | 1 |
| 4 | $CH_3$ | $C_2H_5$ | $C_2H_5$ | 2 |
| 5 | $CH_3$ | $C_3H_9$ | $C_4H_9$ | 2 |
| 6 | H | $C_{10}H_{21}$ | $C_{10}H_{21}$ | 6 |
| 7 | $CH_3$ | $C_{18}H_{37}$ | $C_2H_5$ | 8 |
| 8 | $CH_3$ | 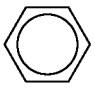 | 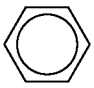 | 2 |

Embodiments of the monomer represented by the general formula (2) are shown in Table 2.

TABLE 2

| Compound No. | Position of group B | R4 | $R^5$ | $R^6$ | n2 |
|---|---|---|---|---|---|
| 9 | 4 | H | $CH_3$ | $CH_3$ | 0 |
| 10 | 4 | $CH_3$ | $CH_3$ | $CH_3$ | 0 |
| 11 | 2 | H | $CH_3$ | $CH_3$ | 2 |
| 12 | 2 | H | $C_2H_5$ | $C_2H_5$ | 0 |
| 13 | 4 | H | $CH_3$ | $CH_3$ | 6 |
| 14 | 3 | $CH_3$ | $C_4H_9$ | $C_4H_9$ | 2 |
| 15 | 4 | H | $C_{10}H_{37}$ | $C_2H_5$ | 8 |
| 16 | 4 | H | 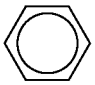 | 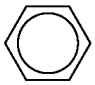 | 2 |

Embodiments of the monomer represented by the general formula (3) are shown in Table 3.

TABLE 3

| Compound No. | $R^7$ | A' | ne | m |
|---|---|---|---|---|
| 17 | H | $—(CH_2)_{n3}—(CF_2)_m—CF_3$ | 0 | 2 |
| 18 | $CH_3$ | $—(CH_2)_{n3}—(CF_2)_mCF_3$ | 2 | 7 |
| 19 | $CH_3$ | $—(CH_2)_{n3}—(CF_2)_m—CF_3$ | 4 | 7 |
| 20 | $CH_3$ | $—(CH_2)_{n3}—(CF_2)_m—CF_3$ | 6 | 5 |
| 21 | H | $(CH_2)_{n3}—(CF_2)_m—CF_3$ | 10 | 9 |
| 22 | H | $—(CH_2)_{n3}—(CF_2)_m—CF(CF_3)_2$ | 0 | 2 |
| 23 | $CH_3$ | $—(CH_2)_{n3}—(CF_2)_m—CF(CF_3)_2$ | 2 | 8 |
| 24 | $CH_3$ | $—(CH_2)_{n3}—(CF_2)_m—(CF_3)_2$ | 4 | 6 |
| 25 | $CH_3$ | $—(CH_2)_{n3}—(CF_2)_m(CF(CF_3)_2$ | 8 | 10 |
| 26 | H | $—(CH_2)_{n3}—(CF_2)_m—CF(CF_3)_2$ | 12 | 12 |

Embodiments of the monomer represented by the general formula (4) are shown in Table 4.

TABLE 4

| Compound No. | $R^8$ | Z | B' | n4 | m |
|---|---|---|---|---|---|
| 27 | H | — | 2-F | — | — |
| 28 | H | — | 4-$CF_3$ | — | — |
| 29 | $CH_3$ | — | 4-F | — | — |
| 30 | H | —O— | $4\text{-}O—(CH_2)_{n4}—(CF_2)_m—CF_3$ | 2 | 7 |
| 31 | H | $—CO_2—$ | $4\text{-}CO_2—(CH_2)_{n4}—(CF_2)_mCF_3$ | 2 | 9 |
| 32 | $CH_3$ | —CONH— | $4\text{-}CONH—(CH_2)_{n4}—(CF_2)_m—CF_3$ | 0 | 7 |
| 33 | H | —O— | $4\text{-}O—(CH_2)_{n4}—(CF_2)_m—CF(CF_3)_2$ | 2 | 8 |
| 34 | H | $—CO_2—$ | $4\text{-}CO_2(CH_2)_{n4}—(CF_2)_m—CF(CF_3)_2$ | 2 | 8 |
| 35 | $CH_3$ | —CONH— | $4\text{-}CONH—(CH_2)_{n4}—(CF_2)_m—CF(CF_3)_2$ | 4 | 10 |

Examples of a copolymer of the first monomer and the second monomer are random copolymer, block copolymer, graft copolymer, copolymer resulted from group transfer polymerization and the like. These copolymers may be polymerized by the known methods such as radical polymerization, anion polymerization, cation polymerization, group transfer polymerization and the like (reference: Shinkobunshikagaku Zikkengaku 2: Synthesis of Polymer Reaction (1). Synthesis of Addition Polymer System, edit. by Kobunshigakkai, published by Kyoritsushuppan Co. Ltd, 1995/06/15, first edition, first print).

A ratio of the first monomer and the second monomer depends upon adjustment of electrostatic charging property and the like regarding the first monomer, and adjustment of imparting low surface energy property regarding the second monomer. However, polymerization may be carried out at an arbitrary ratio. For example, a proportion of the first monomer in copolymerization is 1 to 40% by mole, preferably 2 to 20% by mole, and a proportion of the second monomer in copolymerization is 1 to 40% by mole, preferably 2 to 20% by mole and, preferably, the first and second monomers are 1 to 45% by mole, preferably 2 to 20% by mole.

The coating layer may contain a coupling agent containing a vinyl group. The coupling agent containing a vinyl group is effective for adjusting adhesion of a copolymer constituting the coating layer to a core material, hardness of a copolymer, and the like. A vinylsilane coupling agent is particularly preferable for the coupling agent containing a vinyl group.

Examples of the vinylsilane coupling agent are vinyltrichlorosilane, vinyltrimethoxysilane, triethoxyvinylsilane, γ-methacryloxypropyl methyldimethoxysilane, 3-methacryloxypropyl trimethoxysilane, 3-methacryloxypropyl dimethoxymethylsilane, γ-methacryloxypropyl triethoxysilane, diacetoxymethylvinylsilane, diethoxymethyl vinylsilane, triacetoxyvinylsilane, phenylvinyl dichlorosilane, vinyltriphenoxysilane, 3-methacryloxypropyl methyldichlorosilane, allyltriethoxysilane, 3-allylaminopropyl trimethoxysilane, triisopropoxyvinylsilane, tris(2-methoxyethoxy)vinylsilane, diethoxy 2-piperidino ethoxyvinylsilane, triphenoxyvinylsilane, methacryloxymethyl tris (trimethylsiloxy)silane, 7-octenyltrimethoxysilane, O-(vinyloxyethyl)-(triethoxysilylpropyl)urethane, bis (thorinlylsilyl) itaconate; methacrylamidopropyl triethoxysilane, methacrylamidotrimethylsilane, N-(3-methacryloxy-2-hydroxypropyl)-3 aminopropyl triethoxysilane, (methacryloxymethyl)bis (trimethylsiloxane)methylsilane and the like.

A proportion of a monomer such as these vinylsilane coupling agents to copolymer ranges from 1 to 40% by mole, preferably 2 to 20% by mole.

In addition, the coating layer may contain a monomer containing a vinyl group, if necessary. The monomer containing vinyl group is effective for adjusting glass transition temperature (Tg), for example, from 40 to 70° C. of the resulting copolymer. Further, the monomer is effective for adjusting the properties of the copolymer such as hardness, thermal properties, solubility in a solvent and the like.

Examples of the monomer having vinyl group in the present invention include 2-hydroxyethyl acrylate, 2-hydroxypropyl acrylate, 2-hydroxybutyl acrylate, 2-hydroxy-3-phenyloxypropyl acrylate, 2-hydroxyethyl methacrylate, 2-hydroxypropyl methacrylate, 2-hydroxybutyl methacrylate, 2-hydroxy-3-phenyloxypropyl methacrylate; specific examples of (meth) acrylic alkyl ester are esters having alkyl group of carbon number 1 to 18, acrylic ester derivatives and methacrylic ester derivatives such as methyl (meth)acrylate, ethyl (meth) acrylate, n-butyl (meth)acrylate, isopropyl (meth)acrylate, hexyl (meth)acrylate, 2-ethylhexyl (meth)acrylate, lauryl (meth)acrylate, stearyl (meth)acrylate and the like; styrene derivatives such as styrene, methylstyrene, dimethylstyrene, trimethylstyrene, ethylstyrene, diethylstyrene, triethylstyrene, propylstyrene, butylstyrene, hexylstyrene, heptylstyrene, octylstyrene, nitrostyrene, bromostyrene, acetylstyrene and the like.

A proportion of the monomer having vinyl group in copolymerization is 10 to 95% by mole, more preferably 30 to 90% by mole.

For a method of coating the surface of the core material with the copolymer, the known methods can be used such as an immersing method by immersing core material powders in a solvent to form a coating layer, a spraying method by spraying a solution to form a coating layer on the surface of a core material, a fluidizing method by spraying a solvent to form a coating layer in the state where a core material is floated by flowing air, a kneader coater method by mixing a core material and a solvent to form a coating layer in a kneader coater and removing the solvent and the like.

In addition, any solvents may be used in a coating solvent to form a coating layer as long as they can dissolve the copolymer. Such solvents may include aromatic hydrocarbons such as toluene, xylene and the like; ketones such as acetone, methyl ethyl ketone and the like; ethers such as tetrahydrofuran, dioxane and the like.

Further, the thickness of the coating layer is normally in a range of 0.1 to 10 μm, preferably 0.1 to 5.0 μm.

According to the other aspect of the present invention, there is a carrier for electrophotography as an electrostatic charged member. One embodiment of this carrier for electrophotography is described below.

The carrier for electrophotography of the present invention (hereinafter simply referred to as "carrier") is such that a resin coating layer having intermediate resistance of $10^1$ to $10^8$ Ω•cm is formed on a carrier core having low resistance of dynamic resistance of not greater than 1 Ω•cm under electric field of $10^4$ V/cm in the state of a magnetic brush. The carrier for electrophotography of the present invention can provide both quality of a solid image and prevention of image defects such as brush mark and carrier-over for the following reason: It is presumed that charges are generally rearranged along electric field, giving rise to so-called polarity, when an electrical conducting substance is placed in electric field. The rate of polarizing is related to resistance of an electrical conducting substance. Thus, the smaller resistance is, the faster rate of polarization becomes. It is considered that such phenomenon could occur also in an internal part of a carrier core positioned between a developing roll and a photoreceptor. If resistance of the core is sufficiently low so that polarization of the core is completed during developing step of about $10^{-3}$ seconds, it is considered that development electrode effect resulting from polarization of the core itself happens in addition to charge from a developing roll, to obtain good solid image. However, even if core resistance is low, higher resistance of a resin coating layer makes whole resistance higher to provide no good solid image. On the other hand, since charges from a developing roll flow mainly to the surface of a carrier, if resistance of a resin coating layer is too low, brush mark and carrier-over tends to occur easily. Therefore, a range of electrical resistance of a core and a resin coating layer which satisfies these conditions should be defined as described above.

Further, the structure of a resin coating layer and mechanical strength of the resin can provide improved durability of a carrier. In addition, in order to adjust dynamic electrical resistance of the resin coating layer in the predetermined range, conducting powders are added to the resin coating layer. If an amount of conducting powders to be added is too large, electrostaticall charging property of a carrier is reduced. Thus, it is necessary to suppress the amount to be added to some extent. The fluorinated resin may be used as a resin for a resin coating layer to decrease dispersion property of conducting powders due to low surface energy of the resin. Thus, the resin leads to partially segregated state, and resistance can be lowered even when an amount of conducting powders is small. Therefore, the resin can suppress an amount of conducting powders to be added.

Any known carrier cores may be used in the present invention. In particular, a core made of ferrite having low resistance or magnetic powder dispersed-type resin carrier is preferable.

Other carrier cores such as iron powders and magnetite are also known. However, if utilizing iron powders, a toner or an additive is easy to adhere to the powders because of large specific gravity. Thus, stability of iron powders is inferior as compared with that of ferrite. In addition, if utilize magnetite, there is a problem that it is difficult to control resistance, and latitude of electrical resistance is nallow. On the other hand, if ferrite, it can be made low resistive, for example, by reducing in a hydrogen stream at a certain temperature after calcination and, thereby, ferrite having a variety of electrical resistances may be obtained by controlling an amount of a hydrogen stream, temperature, reducing time and the like. Thus, ferrite is particularly preferable.

Volume average particle size of a carrier core made of magnetic powders such as ferrite or the like is preferably 10 to 100 $\mu$m, more preferably 20 to 80 $\mu$m. When volume average particle size is smaller than 10 $\mu$m, a developer tends to fly and diffuse from a developing apparatus. When volume average particle size is larger than 100 $\mu$m, it is difficult to obtain sufficient image concentration.

On the other hand, a core of magnetic powders dispersed-type resin carrier is powder such as ferrite, iron, or magnetite dispersed in a thermoplastic or a thermosetting resin. Specific examples of such thermoplastic resin and thermosetting resin may include polyolefin resin, polyester resin, polyurethane resin, polycarbonate resin, melamine resin, phenol resin and the like. Particle size of magnetic powders used herein is suitably in a range of 0.01 to 10 $\mu$m, preferably 0.05 to 5 $\mu$m. Volume average particle size of a core of magnetic powders-dispersed resin carrier in which core particles are dispersed in a resin is suitably in a range of 10 to 100 $\mu$m, preferably 20 to 80 $\mu$m as in a case of the above-described magnetic particles.

A carrier core used in the present invention has dynamic electrical resistance of not greater than 1 Ω•cm at electric field of $10^4$ V/cm as determined in the form of a magnetic brush. If electrical resistance of the core is greater than 1 Ω•cm, desired electrical resistance can not be obtained unless electrical resistance of a resin coating layer is considerably low. However, low electrical resistance of a resin coating layer causes image defects. The value of electric field, $10^4$ V/cm is near that of an actual apparatus and the value of electrical resistance is prescribed under the electric field. Dynamic electrical resistance of a carrier core is determined as follows: A plate electrode having an area of 3 $cm^2$ is arranged opposite to a developing roll having diameter of 4 cm and axial length of 10 cm with an interval between the electrode and the roll of 2.5 mm, and a carrier core is placed on the developing roll opposite to the plate electrode to form a magnetic brush. Weight of the carrier core was adjusted to about 40 $mg/cm^2$ per unit area. Voltage is applied between the developing roll and the plate electrode while rotating the developing roll at a rotating rate of 120 rpm, and current which flows thereupon is measured. From the resultant current-voltage properties, resistance is obtained using an equation of Ohm's law. It is well known that there is a relationship of logJ B1/2 between applied electric field R and current density J (for example, Japanese Journal of Applied Physics, vol. 19, No. 12, p2413.) In a case where electrical resistance is considerably low as in a carrier core used in the present invention, measurement can not be carried out in some cases at high electric field of not lower than 103 V/cm since large current flows. In such a case, measurement is carried out at not less than 3 points at low electric field, and electrical resistance is estimated by extrapolating towards electric field of 104 V/cm by method of least squares using the relationship.

A resin in a resin coating layer in the present invention is random copolymer, block copolymer or graft copolymer obtained by copolymerization of, as an essential component, the first monomer represented by the general formula (I) and/or (II) and the second monomer represented by the general formula (III) and/or (IV). For the first monomer, both monomers of the general formulas (I) and (II) may be used or either of them may be used alone. For the second monomer, both monomers of the general formulas (III) and (IV) may be used or either of them may be used alone.

Specific embodiments of the general formulas (I) to (IV) correspond to the above general formulas (1) to (4) (Table 1 to Table 4), respectively, but are not limited thereto.

Additionally, random copolymer, block copolymer or graft copolymer obtained by copolymerization, as an essential component, the third monomer represented by the general formula (V) and/or (VI) in addition to the first and second monomers is preferably in order to improve handling properties such as adjustment of glass transition point and solubility in a solvent in solution polymerization. For the third monomer, both monomers of the general formulas (V) and (VI) may be used or either of them may be used alone.

Examples of the third monomer include, but are not limited to, acrylic acid and acrylic derivatives such as methyl acrylate, ethyl acrylate, butyl acrylate, stearyl acrylate, cyclohexyl acrylate, phenyl acrylate and the like; methacrylic acid and methacrylic derivatives such as methyl methacrylate, ethyl methacrylate, butyl methacrylate, stearyl methacrylate, cyclohexyl methacrylate, 4-tolyl methacrylate, phenyl methacrylate, glycidyl methacrylate and the like; styrenes such as styrene, α-methylstyrene and the like, monomer having epoxyalkyl group; methacryloxypropyltrimethoxysilane and the like.

Further, random copolymer, block copolymer or graft copolymer obtained by copolymerization of a cross linking monomer in addition to the first through third monomers is preferable.

Examples of the cross-linking monomer which can be used in the present invention include, but are not limited ti, 2-hydroxyethyl acrylate, 2-hydroxyethyl methacrylate, 4-divinylbenzene, methacryl isocyanate, acryloxysilanes such as methacryloxypropyltrimethoxysilane and the like.

The monomers are commercially available, and random copolymer, block copolymer or graft copolymer can be synthesized using these monomers by any known methods such as radical polymerization, anion polymerization, cation polymerization and the like.

It is suitable that a proportion of the first monomer is 1 to 99% by mole, preferably 5 to 70% by mole based on total amount of the first monomer and the second monomers.

In addition, it is suitable that a proportion of the third monomer to be incorporated is 0 to 90% by mole, preferably 10 to 90% by mole based on whole resin in a resin coating layer.

Further, it is suitable that a proportion of the cross-linking monomer to be incorporated is 3 to 50% by mole, preferably 5 to 30% by mole based on whole resin in a resin coating layer. When the proportion exceeds 50% by mole, an uncross-linked portion becomes larger even at cross-linking reaction, leading to reduction in stability of electrostatic chaging in circumstances in some cases. When the proportion is less than 2% by mole, the effect obtained by cross-linking, such as strength of coating, leads to insufficient.

It is preferable that conducting powders to be added to a resin coating layer in the present invention have electrical resistance of not greater than $10^6$ Ω•cm, and that conducting particles having volume average particle size of 10 to 500 nm are preferable when they have approximately spherical shape.

It is preferable that conducting particles to be added to a resin coating layer in the present invention have needle-like or fibrous shape. As used herein, "needle-like or fibrous" refers to a ratio of long axis (fiber length) and short axis (fiber diameter) (long axis/short axis; hereinafter referred to as "aspect ratio") of not less than 3, preferably not less than 5, more preferably not less than 10. Since needle-like or fibrous conducting powders tend to form a continuous conducting path in a resin coating layer, an amount thereof to be added may be reduced in comparison with that of spherical conducting powders. Many of conducting powders have a hydroxy group present on the surface thereof and are porous so that water is easily adsorbed thereon. Thus, when an amount of these powders to be added is large, electrical resistance and electrostaticall charging property of a carrier largely vary in response to humidity to cause a variety of problems. Therefore, stability to humidity can be improved by decreasing an amount of conducting powders to be added. In addition, upon dispersion and mixture of conducting powders with a resin coating layer, there is possibility that conducting powders break down in a fiber length direction to lower aspect ratio. For this reason, it is preferable that conducting powders having high aspect ratio are used. In addition, it is desired that, aspect ratio of main conducting powders is in the above-mentioned range to impart the desired electrical resistance to a resin coating layer, even when conducting powders break down.

Conducting powders having long axis of 0.02 to 10 μm are preferable. If long axis is shorter than 0.02 μm with the aspect ratio of not less than 3, more amount of the powders to be added to a resin coating layer is required, because of dispersion stability and electrostatic changing reduction. On the other hand, when long axis is more than 10 μm, a proportion of conducting powders which protrude from the surface of a resin coating layer becomes larger with charge transfer and image defects. The range of short axis of conducting powders is preferably 0.005 to 1 μm. Without this range, dispersibility is deteriorated and properties of a carrier become ununiform.

Any materials which can impart desired electrical resistance to a resin coating layer may be used as a material for conducting powders. Examples thereof include, but are not limited to, single material such as carbon black, zinc oxide, titanium oxide, tin oxide, iron oxide, titanium black and the like, conjugated material such as fine particles of titanium oxide, zinc oxide, aluminium borate and potassium titanate and the like, the surfaces of which are coated with a conducting metal oxide. Examples of the conducting metal oxide include antimony-doped metal oxide such as antimony-doped tin oxide; oxygen-defective metal oxide such as oxygen-defective type tin oxide and the like. Antimony-doped type is preferably used rather than oxygen defective type since water is relatively easily adsorbed on an oxygen-defective site in a case of oxygen-defective type.

The content of conducting powders is preferably 2 to 40% by volume, more preferably 3 to 30% by volume, further preferably 5 to 20% by volume based on volume of a resin coating layer. When the content of conducting powders is less than 2% by volume, resistance of a resin coating layer done not lowered to desired value, whereas when the content of conducting powders is more than 40% by volume, a resin coating layer becomes brittle.

Resistance of a resin coating layer ranges from $10^1$ to $10^9$ Ω•cm, preferably $10^3$ to $10^7$ Ω•cm. Resistance of a resin coating layer depends on and is controlled by type, an amount and the like of conducting powders and a coating resin to be used. If resistance of a resin coating layer is less than $10^1$ Ω•cm, charges tends to transfer on the surface of a carrier to cause image defects. If resistance of a resin coating layer is more than $10^8$ Ω•cm, good solid image can not be obtained even if a carrier having very low resistance is used. Resistance of the resin coating layer is obtained by applying a resin coating layer having thickness of several micrometer less than zero to several micrometer to an ITO conducting glass substrate using an applicator to form a metal electrode thereon by deposition and to determine from current-voltage properties at electric field of $10^2$ V/cm.

A preferable range of dynamic electrical resistance when determined using a carrier having the surface coated with a resin in the form of a magnetic brush is $10^1$ to $1\times10^9$ Ω•cm, more preferably $1\times10^3$ to $1\times10^9$ Ω•cm, at electrical field of $10^4$ V/cm. If the electrical resistance is less than $10^1$ Ω•cm, image defects easily occur. If the electrical resistance is more than $10^9$ Ω•cm, it is difficult to obtain good solid image. Dynamic electrical resistance can be determined as in the carrier core.

Methods for coating a carrier core with a resin composed of the copolymer having dispersed conducting powders therein in the present invention may include an immersing method by immersing a carrier core in a solution in which conducting powders are dispersed and a resin composed of the copolymer is dissolved in a solvent (hereinafter referred to as "solution for forming a resin coating layer"); a spraying method comprising the step of spraying a solution to form a resin coating layer on the surface of a carrier core; a fluidizing method comprising the step of spraying a solution to form a resin coating layer in a state where carrier cores are floated by flowing air; a kneader coater method comprising the step of mixing a carrier core with a solution to form a resin coating layer in a kneader coater and removing a solvent; and the like.

Any solvents which dissolve the coating resin may be used as a solvent for solution to form a resin coating layer. Examples thereof include, but are not limited to, aromatic hydrocarbon such as toluene, xylene and the like; ketones such as acetone, methyl ethyl ketone and the like; and ether such as tetrahydrofuran, dioxane and the like. For means for dispersing conducting powders, there are sand mill, dyno mill, homomixer and the like may be used.

A range of the thickness of a resin coating layer is from 0.3 to 5 μm, preferably 0.5 to 3 μm. If the thickness of a resin coating layer is less than 0.3 μm, it is difficult to form an uniform resin coating layer on the surface of a core. In particular, in a case of a core having low resistance, charge transfer occurs via an exposed surface to produce image defects. On the other hand, if the thickness of a resin coating layer is more than 5 μm, granulation between carriers occur so that carriers having uniform thickness can not be obtained.

The carrier of the present invention is mixed with a toner to provide a two-component developer. The toner is obtained by the steps of melting and kneading a binding resin with a colorant and other additives, being cooled to crush, and optionally classified according to the conventional method.

Examples of the binding resin for the toner are homopolymer or copolymer of styrenes such as styrene, chlorostyrene and the like; monoolefin such as ethylene, propylene, butylene, isoprene and the like; vinyl ester such as vinyl acetate, vinyl propionate, vinyl benzoate and the like; α-methylene aliphatic monocarboxylic ester such as methyl acrylate, ethyl acrylate, butyl acrylate, dodecyl acrylate, octyl acrylate, phenyl acrylate methyl methacrylate, ethyl methacrylate, butyl methacrylate, dodecyl methacrylate and the like; vinyl ether such as vinyl methyl ether, vinyl ethyl ether, vinyl butyl ether and the like; vinyl ketone such as vinyl methyl ketone, vinyl hexyl ketone, vinyl isopropenyl ketone and the like. Particularly representative examples of the binding resin are polystyrene, styrene-acrylic ester copolymer, styrene, methacrylic ester copolymer, styrene-acrylonitrile copolymer, styrene-butadiene copolymer, styrene-maleic anhydride copolymer, polyethylene, polypropylene and the like. Further, examples may include polyester, polyurethane, epoxy resin, silicone resin, polyamide, modified resin, paraffin, waxes and the like.

Representative examples of the colorant are carbon black nigrosine, aniline blue, chalcoin blue, chrome yellow, ultramarine blue, Du Pont oil red, quinoline yellow, methylene blue chloride, phthalocyanine blue, malachite green oxalate, lamp black, rose bengal, C.I. pigment red 48:1, C.I. pigment red 122. C.I. pigment red 57:1, C.I. pigment yellow 97, C.I. pigment yellow 17, C.I. pigment yellow 180, C.I. pigment yellow 185, C.I. pigment yellow 12, C.I. pigment blue 15:1, C.I. pigment blue 15.3 and the like.

Optionally, additives such as known electrostatic controlling agent, fixation aid (polyethylene wax and the like) may be added to a toner. Average volume particle size of the toner is not greater than 30 μm, preferably 3 to 15 μm. For preparing a toner, known methods may be used. For example, there are a method comprising the steps of heating a resin to melt, mixing with a colorant, cooling, crushing and classifying it, as well as a suspension polymerizing method and a dissolution and suspension method under humidity conditions and the like.

A proportion of a toner upon preparation of a developer by mixing a toner and a carrier is preferably in a range of 0.3 to 30% by weight based on the total developer. In addition, in order to improve flowability of a toner, silica, alumina, tin oxide, strontium oxide, various resin powders and other known additives may be added thereto.

The resulting developer may be used in an image forming method comprising the steps forming a latent image on a latent image carrying material, developing the latent image using a developer, transferring a developed toner image onto a transfer material, and heating the developed toner image to fix the toner image on the transfer material.

EXAMPLE

The following Examples further illustrate the present invention in detail. Otherwise mentioned, "part" means part by weight.

Example 1

Preparation of Carrier I-1

(Synthesis of Random Copolymer I 1)

7.05 g (50.0 mmol) of a monomer of No. 2 compound represented by the general formula (1) shown in Table 1, 26.6 g (50.0 mmol) of a monomer of No. 18 compound represented by the general formula (3) shown in Table 3, 85.0 g (0.85 mol) of methyl methacrylate, 12.42 g (50 mmol) of 3-methacyloxypropyltrimethoxysilane were dissolved in 300 g of a solvent, THF, and 1.64 g (10 mmol) of initiator AIBN was added thereto to react at 60° C. for 48 hours under a nitrogen stream. Then, the reaction mixture was precipitated in methanol, filtered and dried in vacuo. A molecular weight of the resulting copolymer was measured by gel permeation chromatography and found to be; weight average molecular weight (Mw)=30,000.

(Preparation of Carrier I-1)

Toluene was added to the copolymer solution so that total solid weight was 10%. Using ferrite particles [F300 (manufactured by Powdertech CO., LTD)] having average particle size of 50 μm as a core material for a carrier, the copolymer solution was added to a heat-vacuum degassing type kneader so that total solid weight in the solution was 0.8 parts based on 100 parts of the core material. Then the mixture was stirred for 30 minutes, heated to 80° C., and pressure was progressively reduced to remove the solvent, to obtain a coated carrier.

Example 2

Preparation of Carrier I-2

(Synthesis of Random Copolymer I-2)

4.9 g (30.0 mmol) of a monomer of No. 10 compound represented by the general formula (2) shown in Table 2, 27.3 g (40 mmol) of a monomer of No. 23 compound represented by the general formula (3) shown in Table 3, 90.0 g (0.87 mol) of styrene, and 15.4 g (70 mmol) of 3-allylaminopropyltrimethoxysilane were dissolved in 300 g of a solvent; toluene, and 1.64 g (10 mmol) of initiator AIBN was added to react at 50° C. for 30 hours under a nitrogen stream. Then, a molecular weight of the resulting copolymer was measured by gel permeation chromatography and found to be; weight average Mw=25,000.

(Preparation of Carrier I-2)

Toluene was added to the copolymer solution so that total solid weight was 10%. Using ferrite particles [F300 (manufactured by Powdertech CO., LTD)] having average particle size of 50 μm as a core material for a carrier, the copolymer solution was added to a heat-vacuum degassing type kneader so that total solid weight in the solution was 0.8 parts based on 100 parts of the core material. Then mixture was stirred for 30 minutes, heated to 90° C., and pressure was progressively reduced to remove the solvent, to obtain a coated carrier.

Example 3

Preparation of Carrier I-3

| | |
|---|---|
| Phenol | 13.0% by weight |
| Formaldehyde (about 37% formaldehyde, about 10% methanol, about 53% water) | 6% by weight |
| Magnetite (particle size; about 0.2 μm) | 81% by weight |

Using ammonia as a basic catalyst and calcium fluoride as a polymerization stabilizer, the above components were gradually heated to a temperature of 80° C. with stirring in an aqueous phase, polymerized for 3 hours, followed by drying at 60° C. in a vacuum drier. The resulting particles were classified with a centrifugation-type classifier (TC-15N: manufactured by NISSIN FLOUR MILLING CO., LTD) to obtain particles having volume average particle size of 50 μm, and a ratio of d90% volume diameter: d10% diameter volume=2.7 (Microtrack, particle size measuring apparatus manufactured by Nikkiso).

As a polymer initiator, poly(triethylene glycol adipate peroxide) (hereinafter referred to as "ATPPO" having Mn=5,800 was synthesized according to the known techniques (reference: Shinkobunshi Jikkengaku 2; Synthesis of Polymers-Reaction (1); Synthesis of Addition Polymer, edit. by Kobunshigakkai, published by Kyoritsushuppan (K.K.), 1995/06/15, first edition, first print).

| | |
|---|---|
| ATPPO | 5 g |
| Styrene | 40 g |
| Monomer of No. 22 compound represented by the general formula (3) shown in Table 3 | 13.6 g |

The above components were dissolved in 300 g of a solvent, dimethylformamide. Then the mixture was polymerized at 70° C. for 180 minutes under a nitrogen stream, followed by precipitation with 15 volumes of ether and drying at 20° C. in vacuo to obtain prepolymer. 30 g of the prepolymer was dissolved in 200 g of toluene 30 g of styrene, 9.3 g of No. 4 compound represented by the general formula (1) shown in Table 1 and 12.4 g of 3-methacryloxypropyltrimethoxysilane were added thereto, followed by polymerizing at 60° C. for 20 hours under a nitrogen stream, then precipitation with 10 volumes of ether and drying at 40° C. in vacuo to obtain a block copolymer.

(Preparation of Carrier I-3)

Toluene was added to the copolymer so that total solid weight was 10%. Using the above phenol resin-dispersed carrier as a core material for a carrier, the copolymer solution was added to a heat-vacuum degassing type kneader so that total solid weight in the solution was 1.2 parts by weight based on 100 parts of the core material. Then the mixture was stirred for 30 minutes, heated to 90° C., and pressure was progressively reduced to remove the solvent, to obtain a coated carrier.

Example 4

Preparation of Carrier I-3

Macromonomer: I-A 27.4 g (0.1 mol) of a monomer of No. 14 compound represented by the general formula (2) shown in Table 2, 1.8 g (0.02 mol) of thioglycolic acid and 164 mg (1 mmol) of AIBN were weighed, reacted at 60° C. for 8 hours under a nitrogen stream, followed by precipitation with 10 volumes of methanol and drying at 40° C. in vacuo, to obtain a prepolymer of Mw=8,000. The carboxyl end prepolymer together with 1,5-fold mole of glycidyl methacrylate, a minor amount of hydroquinone and dimethyl laurylamine was placed in a flask equipped with a reflux condenser, which was dissolved in xylene under nitrogen and stirred at 140° C. for 5 hours, to obtain a macromonomer I-A. An aliquot was taken, titrated with a 0.1N KOH aqueous solution using phenolphthalein/ethanol indicator to confirm no remaining carboxyl group. The resulting macromonomer was precipitated in methanol, filtered off and dried at 40° C. in vacuo. Mw=8400.

Macromonomer: I-B 56 g (0.1 mol) of a monomer of No. 19 compound represented by the general formula (3) shown in Table 3. 1.8 g (0.02 mol) of thioglycolic acid and 164 mg (1 mmol) of AIBN were weighed, reacted at 60° C. for 8 hours under a nitrogen stream, which was precipitated with 10 volumes of methanol and dried at 40° C. in vacuo, to obtain a prepolymer of Mw=13000. The carboxyl end prepolymer together with 1.5-fold mole of glycidyl methacrylate, a minor amount of hydroquinone and dimethyl laurylamine was placed in a flask equipped with a reflux condenser, which was dissolved in xylene under nitrogen and stirred at 140° C. for 5 hours to obtain a macromonomer I-B. An aliquot was taken, titrated with a 0.1N KOH aqueous solution using phenolphthalcin/ethanol indicator to confirm no remaining carboxyl group. The resulting macromonomer was precipitated in methanol, filtered off and dried at 40° C. in vacuo. Mw=14000.

| Synthesis of graft polymer | |
|---|---|
| Macromonomer I A | 10 g |
| Macromonomer I-B | 16 g |
| 3-Methacryloxypropyldimethoxymethylsilane | 8.0 g |
| Styrene | 40 g |
| AIBN | 1.0 g |

The above components were added to 200 g of toluene, which was reacted at 60° C. for 48 hours under a nitrogen stream. The solution was precipitated with 10 volumes of ether, and dried at 40° C. in vacuo to obtain a block copolymer.

(Preparation of Carrier I-4)

Toluene was added to the copolymer solution so that total solid weight was 10%. Using ferrite particles [F300 (manufactured by Powdertech CO., LTD)] having average particle size of 47 μm as a core material for a carrier, the copolymer solution was added to a heat-vacuum degassing type kneader so that total solid weight in the solution was 0.6 parts based on 100 parts of the core material. Then, the mixture was stirred for 30 minutes, heated to 100° C., and pressure was gradually reduced to remove the solvent, to obtain a coated carrier.

Comparative Example 1

Preparation of Control Carrier I-5

A control carrier I-5 was obtained according to the same procedures as those in Example 1, except that the solution of 100 g of polystyrene (Mw; 55,500), 5.0 g of poly N,N-dimethylaminoethyl methacrylate (Mw; 35,000) and 10.0 g of copolymer of poly(methyl methacrylate) and perfluorooctylethyl methacrylate dissolved in 500 ml of toluene was used instead of THF solution.

Comparative Example 2

Preparation of Control Carrier I-6

A control carrier I-6 was obtained according to the same procedures as those in Example 1, except that the solution of 100 g of graft copolymer of polystryene and poly N,N-dimethylaminoethyl methacrylate (Mw; 45,500) and 10.0 g of block copolymer of poly(methyl methacrylate) and perfluorooctylethyl methacrylate dissolved in 500 ml of toluene was used instead of THF solution.

Example 5

Resin preparation I-1 (hereinafter referred to as "resin I-1")

Polyoxyethylene (2,2) 2,2-bis(4-hydroxyphenyl)propane: 1.3 mol (300)

Polyoxypropylene (2,2)-2,2-bis(4-hydroxyphenyl) propane: 1.0 mol (326)

Terephthalic acid: 2.3 mol (166)

The above raw compounds were placed in a four-neck glass flask, which was equipped with a stirring bar, a condenser, a nitrogen introducing tube and a thermometer, and mounted on a mantle heater. An interior of a reaction vessel was substituted with nitrogen gas, 1 g of dibutyl oxide was added, which was reacted first at about 150° C. at ambient pressure in a nitrogen stream while heating with a mantle heater, followed at 220° C. under reduced pressure. After completion of the reaction, the reaction mixture was allowed to cool to room temperature to obtain a resin having glass transition temperature Tg of 64° C. This is referred to as "polyester I-A" hereinafter.

| Preparation of melt flushing pigment I-1 | |
|---|---|
| The above toner resin I · 1 | 100 parts |
| Cyan pigment (C.I. pigment blue 15:3) hydrated paste (water content in hydrated paste - 30 wt %) | 62 parts |

Water in a pigment hydrated paste was substituted with polyester I-A to remove water while melting and kneading the above components with a pressure kneader, to prepare cyan flushing pigment I-a having 30% by weight of a pigment.

Preparation of Melt Flushing Pigment I-2

Magenta flushing pigment I b having 30% by weight of a pigment was prepared according to the same manner as that in pigment preparation I-1 by substituting cyan pigment (C.I. pigment blue 15:3) hydrated paste with a pigment (C.I. pigment red 57:1) hydrated paste.

Preparation of Melt Flushing Pigment I-3

Yellow flushing pigment I-c having 30% by weight of a pigment was prepared according to the same manner as that in pigment preparation I-1 by substituting cyan pigment (C.I. pigment blue 15:3) hydrated paste with a yellow pigment (C.I. pigment yellow 17) hydrated paste.

| Example 6 Preparation of toner T-1 (black toner) | |
|---|---|
| Resin I-1 | 96 parts |
| Carbon black (primary particle size: 48 μm) | 4 parts |

The above components were melted and kneaded with a banbury mixer, cooled, crushed with a jet-type micronizer, and particle size dispersion was adjusted with a classifier. The resulting particle size was as follows, volume average diameter d50=7.2 μm, and volume particle size dispersion d16/d84=1.7 (as measured by Coulter counter).

To the toner were added 0.7 parts of fine powders of silica (R 812/manufactured by Nihon Aerosil) and 0.8 parts of hydrophobic titanium oxide (MT-100S: manufactured by TAYCA CORPORATION) as an additive based on 100 parts of the toner, which were mixed with a Henschel mixer to obtain an additive toner.

Example 7

Preparation of Toner I-2 (Cyan Toner)

14 Parts of a flushing pigment I-a and 86 parts of a resin I-1 were premixed, melted and kneaded with a banbury mixer, cooled, crushed with a jet mill and classified to obtain a cyan toner having 4% by weight of a pigment as well as volume average diameter d50=7.2 μm and volume particle size dispersion d16/d84=1.6.

To the toner were added 0.7 parts of fine powders of silica (R 812/manufactured by Nihon Aerosil) and 0.8 parts of hydrophobic titanium oxide (MT-100S: manufactured by TAYCA CORPORATION) as an additive based on 100 parts of the toner, which were mixed with a Henschel mixer to obtain an additive toner I-2.

EXAMPLE 8

Preparation of Toner I-3 (Magenta Toner)

14 parts of a flushing pigment I-b and 86 parts of a resin I-1 were premixed, melted and kneaded with a banbury mixer, cooled, crushed with a jet mill and classified to obtain a magenta toner having 4 wt % of the pigment content as well as volume average diameter d50=7.2 μm and volume particle size dispersion d16/d84=1.6.

To the above toner were added 0.7 parts of fine powders of silica (R 812/manufactured by Nihon Aerosil) and 0.8 parts of hydrophobic titanium oxide (MT-100S: manufactured by TAYCA CORPORATION) as an additive based on 100 parts of the toner, which were mixed with a Henschel mixer to obtain an additive toner I-3. Further, 8 parts of this additive toner was mixed with a ferrite carrier coated with styrene-methyl methacrylate polymer to obtain a magenta developer.

Example 9

Preparation of Toner I-4 (Yellow Toner)

16.7 Parts of a flushing pigment and 83.3 parts of a resin I-1 were premixed, melted and kneaded with banbury mixer, cooled, crushed with a jet mill and classified to obtain a yellow toner having 4% by weight of the pigment content as well as volume average diameter d50=7.2 μm and volume particle size dispersion d16/d84=1.6.

To the toner were added 0.7 parts of fine powders of silica (R 812/manufactured by Nihon Aerosil) and 0.8 parts of hydrophobic titanium oxide (MT-100S: manufactured by TAYCA CORPORATION) as an additive based on 100 parts of the toner, which were mixed with a Henschel mixer to obtain an additive toner I-4.

| Example 10<br>Preparation of a developer | |
|---|---|
| Toner I-1 to T-4 | 10 parts, respectively |
| Carrier I-1 to I-6 | 100 parts, respectively |

The above components were mixed with a V blender to prepare a color developer, which was introduced into a digital full color machine A color (A COLOR 635) (manufactured by Fuji Xerox) to take a color copy sample using a colored manuscript, to obtain image quality equal to or superior over A color.

In addition, color copy samples were continuously taken to investigate charge amount, fog and image quality maintaining properties. Charge amount was measured using a blow off charge amount measuring apparatus TB-200 manufactured by Toshiba. Fog and image quality maintaining properties were evaluated organoleptically and property of toner adhering to a carrier was observed with Scanning Electron Microscope (SEM).

Criterion for Evaluating Image Quality (Image Quality Maintaining Properties)

○: Little unevenness in concentration and color difference, non marked fog

Δ: Slight unevenness in concentration and color difference, perceivable but not marked fog x: severe fog, insufficient concentration and marked unevenness in concentration (Fog)

○: Not marked fog

Δ: Perceivable fog x: severe fog

Results are shown in Table 5.

TABLE 5

| Carrier | Charge amount of a toner after 10th copying (μC/g):(Cyan toner) 30° C./80% | 23° C./40% | 10° C./10% | Charge amount of a toner after 100000th copying (Cyan toner) (μC/g) 22° C./40% | Image quality maintaining property Full color, fours colors 22° C./40% After 10000 copying | After 100000 copying | Fog Full color; fours colors 22° C./40% After 10000 copying | After 100000 copying |
|---|---|---|---|---|---|---|---|---|
| I-1 | −21.3 | −23.6 | 24.3 | −20.5 | ○ | ○ | ○ | ○ |
| I-2 | −21.0 | 24.7 | −22.2 | −20.1 | ○ | ○ | ○ | ○ |
| I-3 | 20.3 | −23.5 | −25.4 | −19.7 | ○ | ○ | ○ | ○ |
| I-4 | 22.3 | −25.0 | −26.7 | −21.7 | ○ | ○ | ○ | ○ |
| I 5 | −12.3 | −20.0 | −26.0 | −8.6 | ○ | Δ | ○ | X |
| I-6 | −10.3 | −17.5 | −26.7 | −7.4 | ○ | X | Δ | X |

Examples for a Sleeve for Electrostatic Development

Example 11

The resin used in Example 2 was dissolved in a solvent toluene so that solid was 8% by weight, and a coating layer having the thickness of about 2 μm was formed, by dipping, on the surface of a developing roll sleeve (made of stainless steel) for a laser printer 4105 manufactured by Figi Xerox. Thereafter, this sleeve was heated to cure at 200° C. for 30 minutes in a heating chamber to obtain an electrostatically charged sleeve.

Comparative Example 3

A developing roll sleeve (made of stainless steel) for a laser printer 4105 manufactured by Figi Xerox was used as it was.

Sleeves obtained in Example 11 and Comparative Example 3 were mounted on an improved laser printer 4105 manufactured by Fiji Xerox, and image quality evaluation experiment was carried out using the black toner of Example 6 to obtain the results shown in Table 6.

TABLE 6

| | Initial | | After 10000 copying | |
|---|---|---|---|---|
| | Concentration of solid part | Staining of background | Concentration of solid part | Staining of background |
| Example 11 | Good | No | Good | No |
| Comp. Ex. 3 | Good | No | Low Concentration | Yes |

In the measurement of electrical resistance for Examples and Comparative Examples below, all experiments were carried out at a temperature of 22° C. and humidity of 55%.

[Synthesis of a Polymer]

Polymer Synthesis II-1

(Synthesis of Random Copolymer II-1)

7.85 g (50.0 mmol) of a monomer of the compound No. 2, 27.0 g (50.0 mmol) of the compound No. 18 and 100.0 g (1.0 mol) of methyl methacrylate were dissolved in 300 g of toluene. 1.8 g (0.01 mol) of azoisobutyronitrile was added thereto to react at 60° C. for 20 hours under a nitrogen stream. After completion of the reaction, a molecular weight of the resulting copolymer was measured by gel permeation chromatography and found to be weight average Mw of 23,000.

Polymer Synthesis II-2

(Synthesis of Random Copolymer II-2)

1.6 g (10.0 mmol) of a monomer of the compound No. 9, 20.3 g (50.0 mmol) of a monomer of the compound No. 30 and 100.0 g (0.96 mol) of styrene were dissolved in 300 g of toluene. 1.8 g (0.01 mol) of azoisobutyronitrile was added thereto to react at 60° C. for 40 hours under a nitrogen stream. After completion of the reaction, a molecular weight of the resulting copolymer was measured by gel permeation chromatography and found to be weight average Mw of 45,000.

Polymer Synthesis II-3

(Synthesis of Block Copolymer II-1)

100.0 g (0.59 mol) of cyclohexyl methacrylate was dissolved in 300 g of toluene. 0.59 g (0.006 mol) of azoisobutyronitrile was added thereto to react at 60° C. for 4 hours under a nitrogen stream to obtain a prepolymer. 1.75 g (10.0 mmol) of a monomer of the compound No. 10 was dissolved in 30 g of toluene. 0.02 g of azoisobutyronitrile was added thereto to react at 60° C. for 4 hours under a nitrogen stream. Then, 7.2 g (10.0 mmol) of a monomer of the compound No. 33 and the above prepolymer were added thereto to further react at 60° C. for 48 hours under a nitrogen stream. After completion of the reaction, a molecular weight of the resulting copolymer was measured by gel permeation chromatography and found to be weight average Mw of 55,000.

Polymer Synthesis II-4

(Synthesis of Graft Copolymer II-1)

7.85 g (10.0 mmol) of a monomer of the compound No. 2 and 5.6 g (10.0 mmol) of a monomer of the compound No. 19 were dissolved in 300 g of toluene. Then, 0.18 g (0.001 mol) of azoisobutyronitrile was added thereto to react at 60° C. for 4 hours under a nitrogen stream. Then, 100.0 g (0.70 mol) of glycidyl methacrylate and 1.8 g (0.01 mol) of azoisobutyronitrile were added thereto to further react at 60° C. for 48 hours under a nitrogen stream. After completion of the reaction, a molecular weight of the resulting copolymer was measured by gel permeation chromatography and found to be weight average Mw of 85,000.

Polymer Synthesis II-5

(Synthesis of Graft Copolymer II-2)

1.75 g (10.0 mmol) of a monomer of the compound No. 11 and 5.7 g (10.0 mmol) of a monomer of the compound No. 30 were dissolved in 300 g of toluene. Then, 0.18 g (0.001 mol) of azoisobutyronitrile was added thereto to react at 60° C. for 4 hours under a nitrogen stream. Then, 100.0 g (0.70 mol) of glycidyl methacrylate and 1.8 g (0.01 mol) of azoisobutyronitrile were added thereto to further react at 60° C. for 48 hours under a nitrogen stream. After completion of the reaction, a molecular weight of the resulting copolymer was measured by gel permeation chromatography and found to be weight average Mw of 45,000.

Polymer Synthesis II-6

(Synthesis of Random Copolymer II-3)

7.85 g (50.0 mmol) of a monomer of the compound No. 2, 26.6 g (47.5 mmol) of a monomer of the compound No. 17, 85.0 g (0.85 mol) of methyl methacrylate and 12.42 g (50 mmol) of 3-methacryloxypropyltrimethoxysilane were dissolved in 300 g of a solvent toluene. Then, 1.64 g (10 mmol) of AIBN was added thereto to react at 60° C. for 48 hours under a nitrogen stream. After completion of the reaction, the reaction mixture was precipitated in methanol, filtered off and dried in vacuo. A molecular weight of the resulting copolymer was measured by gel permeation chromatography and found to be weight average Mw of 30,000

[Preparation of a Carrier]

| Example 12 | |
|---|---|
| Magnetite (MX030A, volume average particle size 50 μm, manufactured by FDK CORPORATION) | 100 parts by weight |
| Toluene | 13.5 parts by weight |
| Polymer of Polymer Synthesis II-1 | 1.8 parts by weight |
| Carbon black (VXC72, $10^{-1}$ Ω · cm, particle size 30 nm, manufactured by Cabot) | 0.3 part by weight |

The above components except for magnetite were dispersed for 1 hour with a sand mill to obtain a solution for forming a resin coating layer. Then, the solution and magnetite were placed in a vacuum degassing-type kneader, stirred at 60° C. for 30 minutes at a reduced pressure, to form a resin coating layer and a carrier II-A. The thickness of the resin coating layer was 0.8 μm.

In addition, the content of carbon black (VXC72) in the resin coating layer was 8% by volume. This carrier was observed with scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Magnetite and the carrier II-A were measured for electrical resistance in the form of a magnetic brush. The resistance values obtained by extrapolating towards electric field of $10^4$ V/cm were found to be $4\times10^{-5}$ Ω•cm and $1.8\times10^{8}$ Ω•cm, respectively. A graph for these resistance values is shown in FIG. 1. Resistance value of the resin coating layer was $3\times10^{5}$ Ω•cm at electric field of 100 V/cm.

| Example 13 | |
|---|---|
| Ferrite (MF · 35, volume average particle size 35 μm, manufactured by Powdertech CO., LTD) | 100 parts by weight |
| Toluene | 22 parts by weight |
| Polymer obtained by Polymer Synthesis TT-2 | 3 parts by weight |
| Carbon black (Monak 880, $10^{-1}$ Ω · cm, volume average particle size 16 nm, manufactured by Cabot) | 0.8% by weight |

The above components except for magnetite were dispersed for 1 hour with a sand mill to obtain a solution for forming a resin coating layer. Then, the solution and magnetite were placed in a vacuum degassing-type kneader, stirred at 60° C. for 30 minutes at a reduced pressure, to form a resin coating layer and a carrier II B. The thickness of the resin coating layer was 0.8 μm. In addition, the content of carbon black (Monak 880) in the resin coating layer was 13% by volume. This carrier was observed with scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Magnetite and the carrier II-D were measured for electrical resistance in the form of a magnetic brush. The resistance values obtained by extrapolating towards electric field of $10^4$ V/cm were found to be $5\times10^{-2}$ Ω•cm and $4\times10^{7}$ Ω•cm, respectively. Resistance value of the resin coating layer was $2\times10^{3}$ Ω•cm at electric field of 100 V/cm.

| Example 14 | |
|---|---|
| Phenol | 13.0% by weight |
| Formaldehyde (about 37% formaldehyde, about 10% methanol, about 53% water) | 6% by weight |
| Magnetite (volume average particle size about 0.2 μm) | 81% by weight |

Using ammonia as a basic catalyst and calcium fluoride as a polymerization stabilizer, the above components were gradually heated to 80° C. with stirring in an aqueous phase to polymerize for 3 hours, followed by drying well at 60° C. in vacuo. The resulting particles were classified by a centrifugation-type classifier (TC-15N: manufactured by NISSIN FLOUR MILLING CO., LTD) to obtain a carrier core II-1 having volume average particle size of 50 μm and a ratio of d90% volume diameter/d10% volume diameter= 2.7 [measuring apparatus, Microtrack (trade name), manufactured by Nikkiso].

| | |
|---|---|
| The above carrier core TT-1 | 80 parts by weight |
| Toluene | 14 parts by weight |
| Polymer of Polymer synthesis II-3 | 2 parts by weight |
| Tin oxide (Pastran TYPE · IV, 1 Ω · cm, volume average particle size 100 nm, manufactured by MITSUI MINING & SMELTING CO., LTD) | 2 parts by weight |

The above components except for the carrier core II-1 were dispersed for 1 hour with a sand mill to obtain a solution for forming a resin coating layer. Then, the solution and the carrier core II 1 were placed in a vacuum degassing-type kneader, stirred at 60° C. for 30 minutes at a reduced pressure, to form a resin coating layer and a carrier II-C. The thickness of the resin coating layer was 0.8 μm.

In addition, the content of tin oxide in the resin coating layer was 13% by volume. This carrier was observed with scanning electron microscope and found to have no exposed surface and confirmed to be uniformly covered with a resin.

Further, the solution for forming a resin coating layer was coated on an ITO conducting glass substrate using an applicator so that the thickness was 0.8 μm to obtain a sample for measuring electrical resistance of the resin coating layer.

The carrier core II-1 and the carrier were measured for electrical resistance in the form of a magnetic brush. The resistance values obtained by extrapolating towards electric field of $10^4$ V/cm were found to be $1\times10^{-1}$ Ω•cm and $2\times10^6$ Ω•cm, respectively. Resistance value of the resin coating layer was $6\times10^4$ Ω•cm at electric field of 100 V/cm.

| Example 15 | |
|---|---|
| Iron powders (TSV, volume average particle size 60 μm, manufactured by Powdertech CO., LTD) | 100 parts by weight |
| Toluene | 0 parts by weight |
| Polymer of Polymer Synthesis II-5 | 1 part by weight |
| Carbon black (VXC72, $10^{-1}$ Ω · cm, voluem averahe particle size 30 nm, manufactured by Cabot) | 0.2 part by weight |

The above components except for iron powders were dispersed for 1 hour with a sand mill to obtain a solution for forming a resin coating layer. Then, the solution and iron powders were placed in a vacuum degassing-type kneader, stirred at 60° C. for 20 minutes at a reduced pressure, to form a resin coating layer to obtain a carrier II-D. The thickness of the resin coating layer was 0.8 μm. In addition, the content of carbon black (VXC 72) in the resin coating layer was 10% by volume. The carrier was observed with scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Iron powders and the carrier core II-D were measured for electrical resistance in the form of a magnetic brush and the resistance values obtained by extrapolating towards electric field of $10^4$ V/cm were found to be $1\times10^{-14}$ Ω•cm and $2\times10^3$ Ω•cm, respectively. Resistance value of the resin coating layer was $8\times10^3$ Ω•cm at electric field of 100 V/cm.

| Comparative Example 4 | |
|---|---|
| Ferrite (C28 · FB, volume average particle size 50 μm, manufactured by FDK CORPORATION) | 100 parts by weight |
| Toluene | 14.5 parts by weight |
| Methyl methacrylate/diethylamine methacrylate copolymer (copolymerization ratio 70:30, weight average MW: 52000) | 2 parts by weight |

A solution for forming a resin coating layer obtained by dissolving the above polymer in toluene and ferrite were placed in a vacuum degassing-type kneader, stirred at 60° C. for 20 minutes at a reduced pressure, to form a resin coating layer and a carrier II-E. The thickness of the resin coating layer was 0.8 μm. The carrier was observed with scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Ferrite and the carrier core II-E were measured for electrical resistance in the form of a magnetic brush. The resistance values obtained by extrapolating towards electric field of $10^4$ V/cm were found to be $1\times10^{-5}$ Ω•cm and $6.3\times10^{10}$ Ω•cm, respectively. Further, the value of the carrier II-E at electric field of 400 V/cm was $1.0\times10^{11}$ Ω•cm and that at electric field of 4000 V/cm was $9.8\times10^{10}$ Ω•cm. In addition, resistance value of the resin coating layer was $1\times10^{13}$ Ω•cm at electric field of 100 V/cm. The Comparative Example shows that rapid change in resistance depended on electric field was not observed when a resin having high resistance was uniformly coated on a core having low resistance.

| Example 6 | |
|---|---|
| Ferrite (C28 · FB, volume average particle size 50 μm, manufactured by FDK CORPORATION) | 100 parts by weight |
| Toluene | 12.3 parts by weight |
| Polymer obtained by Polymer Synthesis II-1 | 0.43 part by weight |
| Carbon black (VXC72, $10^1$ Ω · cm, volume average particle size 30 nm, manufactured by Cabot) | 0.07 part by weight |

The above components except for ferrite were dispersed for 1 hour with a sand mill to obtain a solution for forming a resin coating layer. Then, the solution and ferrite were placed in a vacuum degassing-type kneader, stirred at 60° C. for 20 minutes at a reduced pressure, to form a resin coating layer and a carrier II-F. The thickness of the resin coating layer was 0.2 μm. The content of carbon black in the resin coating layer was same as in Example 1. The carrier was observed with scanning electron microscope and found to have exposed surface and is partially coated with a resin.

Further, the solution for forming a resin coating layer was coated on an ITO conducting glass substrate using an applicator so that the thickness was 0.8 μm to obtain a sample for measuring electrical resistance of the resin coating layer.

The carrier core II-F was measured for electric resistivity in the form of a magnetic brush. The resistance value obtained by extrapolating towards electric field of $10^4$ V/cm was found to be $4.2\times10^6$ Ω•cm. Dynamic electrical resistance of ferrite was the similar to that in Comparative Example 1. In addition, resistance value of the resin coating layer was $3\times10^6$ Ω•cm at electric field of 100 V/cm.

| Example 17 | |
|---|---|
| Magnetite (MX 030A, volume average particle size 50 μm, manufactured by FDK CORPORATION) | 80 parts by weight |
| Tolene | 14 parts by weight |
| Polymer obtained by Polymer Synthesis II-6 | 2 parts by weight |
| Tin oxide (Pastran TYPE-IV, 1 Ω · cm, volume average particle size 100 nm, manufactured by MITSUI MINING & SMELTING CO., LTD) | 2 parts by weight |

The above components except for magnetite were dispersed for 1 hour with a sand mill to obtain a solution for forming a resin coating layer. Then, the solution and magnetite were placed in a vacuum degassing-type kneader, stirred at 60° C. for 30 minutes at a reduced pressure, to form a resin coating layer. Then, the mixture was further heated to 100° C. with stirring slowly to perform a cross-linking reaction for 20 minutes, to obtain a carrier II-G. The thickness of the resin coating layer was 0.8 μm.

In addition, the content of tin oxide in the resin coating layer was 13% by volume. The carrier was observed with scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Magnetite and the carrier core II-G were measured for electrical resistance in the form of a magnetic brush. The resistance values obtained by extrapolating towards electric field of $10^4$ V/cm were found to be $1\times10^{-1}$ Ω•cm and $3\times10^6$ Ω•cm, respectively. In addition, resistance value of the resin coating layer was $6.5\times10^4$ Ω•cm at electric field of 100 V/cm.

| Comparative Example 5 | |
|---|---|
| Ferrite (F-300, volume average particle size 50 μm, manufactured by Powdertech CO., LTD) | 100 parts by weight |
| Toluene | 12.3 parts by weight |
| Styrene methyl methacrylate copolymer (ratio of copolymerization 20:80, weight average Mw; 36000) | 1.7 parts by weight |
| Carbon black (VXC72, $10^{-1}$ Ω · cm, volume average particle size 30 nm, manufactured by Cabot) | 0.6 part by weight |

The above components except for ferrite were dispersed for 1 hour with a sand mill to obtain a solution for forming a resin coating layer. Then, the solution and ferrite were placed in a vacuum degassing-type kneader, stirred at 60° C. for 20 minutes at a reduced pressure, to form a resin coating layer and a carrier II-H. The thickness of the resin coating layer was 0.8 μm. In addition, the content of carbon black (VXC 72) in the resin coating layer was 17% by volume. The carrier was observed with scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Ferrite and the carrier II-H were measured for resistance in the form of a magnetic brush. The values at electric field of $10^4$ V/cm were $9.1\times10^7$ Ω•cm (measured value) and $1\times10^2$ Ω•cm (extrapolated value), respectively. In addition, resistance value of the resin coating layer was $3\times10^0$ Ω•cm at electric field of 100 V/cm.

| Comparative Example 6 | |
|---|---|
| Ferrite (EFC-50B, volume average particle size 50 μm, manufactured by Powdertech CO., LTD) | 100 parts by weight |
| Toluene | 12.6 parts by weight |
| Styrene-methyl methacrylate copolymer (ratio of copolymerization 20:80, weight average Mw; 36000) | 1.7 parts by weight |
| Carbon black (VXC72, $10^{-1}$ Ω · cm, volume average particle size 30 nm, manufactured by Cabot) | 0.55 part by weight |

The above components except for ferrite were dispersed after 1 hour with a sand mill to obtain a solution for forming a resin coating layer. Then, the solution and ferrite were placed in a vacuum degassing-type kneader, stirred at 60° C. for 20 minutes at a reduced pressure, to form a resin coating layer and a carrier II-I. The thickness of the resin coating layer was 0.8 μm. In addition, the content of carbon black (VXC 72) in the resin coating layer was 15% by volume. The carrier was observed with scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Ferrite and the carrier II-I were measured for resistance in the form of a magnetic brush. The values obtained by extrapolating towards electric field of $10^4$ V/cm were $1\times10^5$ Ω•cm and $8\times10^4$ Ω•cm, respectively. In addition, resistance value of the resin coating layer was $8\times10^0$ Ω•cm at electric field of 100 V/cm

Comparative Experiment 7

A carrier II-J was obtained according to the same manner as that in Example 12 except that the composition of a polymer was used as follows:

| [Polymer composition] | |
|---|---|
| Polystyrene (weight average MW; 55,500) | 100 parts by weight |
| Poly N,N-dimethylaminoethyl methacrylate (weight average Mw; 35,000) | 5.0 parts by weight |
| Copolymer of methyl methacrylate and perfluorooctylethyl methacrylate (copolymerization ratio 80:10:10, weight average Mw; 15,000) | 10.0 parts by weight |

The resulting carrier was observed with a scanning electron microscope and found to have no exposed surface and confirmed to be uniformly coated with a resin.

Further, the solution for forming a resin coating layer was coated on an ITO conducting glass substrate using an applicator so that the thickness was 0.8 μm to obtain a sample for measuring electrical resistance of the resin coating layer.

Magnetite and the carrier II-J were measured for resistance in the form of a magnetic brush. The values obtained by extrapolating towards electric field of $10^4$ V/cm were $4\times10^{-5}$ Ω•cm and $1.8\times10^8$ Ω•cm, respectively. In addition, resistance value of the resin coating layer was $3\times10^5$ Ω•cm at electric field of 100 V/cm.

| [Method for preparing a toner] | |
|---|---|
| Linear polyester resin (linear polyester obtained from terephthalic acid/ethylene oxide · added bisphenol A/cyclohexanedimethanol; Tg = 62° C. Mn = 4,000, Mw = 12,000, acid value = 12, hydroxide value = 25) | 100 parts by weight |
| Magenta pigment (C.I. pigment red 57) | 4 parts by weight |

The above mixture was kneaded with an extruder, crushed with a jet mill and classified with an air classifier to obtain a magenta toner of $d_{50}$–7 μm.

[Evaluation Test]

Each 100 parts by weight of the carriers obtained in Examples 12 to 17 and Comparative Examples 4 to 7 was mixed with 8 parts by weight of the above magenta to obtain respective developers corresponding to the carriers of Examples 12 to 17 and Comparative Examples 4 to 7. The following copying test was carried out on these developers using an electrophotography copying machine (manufactured by Fuji Xerox, A-Color 630) under the evaluation circumstance at a temperature of 22° C. and humidity of 55%.

(Image Concentration)

A solid image (20×20 $mm^2$) having manuscript concentration of 1.30 was copied, relative reflective concentration of an output image relative to a white paper was measured at 10th copying and 50,000th copying with a Macbeth concentration measuring apparatus. Regarding the result of 50,000th copying, difference in image concentration of within 0.1 relative to manuscript concentration (1.30) was judged to be good in image concentration stability which was designated (○) and difference in image concentration over the above value was designated (x).

(Unevenness in Concentration on the Surface)

A solid image (20×20 $mm^2$) of manuscript concentration 1.30 was copied, and an output image was organoleptically evaluated by visual observation by setting a limited specimen. Non-unevenness was judged as Ô, unevenness having practically no problem as (○) and unevenness as (X). Evaluation was carried out at 10th copying and 50,000th copying.

(Brush Mark)

The number of white marks appeared on an output image per unit length (5 mm) in right angle direction relative to a brush direction was evaluated with a microscope. Evaluation was carried out at the first copying.

The test results are shown in the following Table 7.

TABLE 7

| Ex. or Comp. Ex. | Carrier | Image concentration 10th copying | Image concentration 50000th copying | Stability | Unevenness in concentration 10th copying | Unevenness in concentration 50000th copying | Brush mark (number/5 mm) 1st copying |
|---|---|---|---|---|---|---|---|
| Example 12 | II-A | 1.32 | 1.33 | ◎ | ◎ | ◎ | 0 |
| Example 13 | II B | 1.34 | 1.36 | ◎ | ◎ | ◎ | 0 |
| Example 14 | II-C | 1.30 | 1.27 | ◎ | ◎ | ◎ | 0 |
| Example 15 | II-D | 1.31 | 1.21 | ◎ | ◎ | ○ | 1 |
| Example 16 | II-F | 1.29 | 1.22 | ◎ | ◎ | ○ | 1 |
| Example 17 | II-G | 1.33 | 1.31 | ◎ | ◎ | ◎ | 0 |
| Comparative Example 4 | II-E | 1.18 | 1.30 | X | X | X | 0 |
| Comparative Example 5 | II-H | 1.23 | 0.98 | X | X | X | 4 |
| Comparative Example 6 | II-I | 1.27 | 1.18 | ◎ | X | X | 6 |
| Comparative Example 7 | II-J | 1.32 | 1.15 | X | ◎ | X | 0 |

The table 7 showed that high solid image concentration was obtained and no or little unevenness in concentration and change with the period of time was present when the present carriers (II A, II-B, II-C, II-D, II-F and II-G) were used. Further, no or little brush mark was present. Carrier II-D was slightly inferior in stability as compared with II-A, II-B and II-C. In addition, when a core having low resistivity was coated with a thinner resin coating layer having intermediate resistance as in carrier II-F, as compared with carrier II-A of Example 12, slight brush mark occurred. It is considered that slight brush mark occurs because charge leaks through the exposed surface although resistance of a carrier is in a desired range.

On the other hand, when a core having low resistance was uniformly coated with a resin having high resistance as in carrier II-E of Comparative Example, no brush mark was observed. However, unevenness in concentration was observed at central and peripheral parts of a solid image and image concentration was low. It is considered that IMB-like properties appeared because resistance of a carrier become over a desired value due to higher resistance of a resin coating layer. When a resin coating layer having low resistance was formed on a core with high resistance as in carrier II-H of Comparative Example, brush mark occurred and image concentration was low and unevenness in concentration was observed. When a resin coating layer having low resistance was formed on a core having intermediate resistance as in carrier II-1 of Comparative Example, brush mark also occurred and image concentration was low and unevenness in concentration was seen. It is considered that image defects occurred due to lower resistance of the resin coating layer although resistance of the carriers was within a desired range.

Carrier II-J of Comparative Example 7 lacks image stability over a period of time. It is considered that defects of the resin coating layer occurs earlier because non-compatible resins were used in the resin coating layer.

The results showed that a high quality color image with no image defects is obtained by forming uniformly a resin coating layer having intermediate resistance on a core having low resistance to control resistance of a carrier in a desired range.

What is claimed is:

1. A coating member for a charged member for electrostatic development which comprises a copolymer comprised of a first monomer component(s) represented by a general formula (1) and/or (2) below, and a second monomer component(s) represented by a general formula (3) and/or (4) below:

(1)

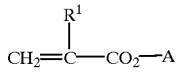

wherein $R^1$ is a hydrogen atom or a methyl group, A is $—(CH_2)_{n1}—NR^2R^3$ ($R^2$ and $R^3$ are an alkyl group, and an aryl group, and $n_1$ is an integer of 0 to 10);

(2)

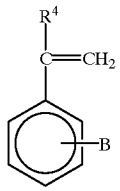

wherein $R^4$ is a hydrogen atom or a methyl group, B is $—(CH_2)_{n2}—NR^5R^6$ ($R^5$ and $R^6$ are an alkyl group, and an aryl group, $n_2$ is an integer of 0 to 10);

(3)

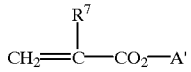

wherein $R^7$ is a hydrogen atom or a methyl group, A' is $—(CH_2)_{n3}—(CH_2)_m—CF_3$ or $—(CH_2)_{n3}—(CF_2)_m—CF_3$ or $—(CH_2)_{n3}—(CF_2)_m—CF(CF_3)_2$ ($n_3$ is an integer of 0 to 8, and m is an integer of 1 to 10); and (4)

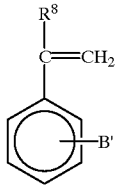

wherein $R^8$ is a hydrogen atom or a methyl group, B' is a fluorine atom, a trifluoromethyl group, $—Z—(CH_2)_{n3}—(CF_2)_m—CF_3$ or $—Z—(CH_2)_{n3}—(CF_2)_m—CF(CF_3)_2$ ($n_3$ is an integer of 0 to 8, m is an integer of 1 to 10, and Z is an oxygen atom, a carbonyl group or an acid amide group).

2. The coating member according to claim 1, wherein said coating member contains a polymer selected from the group consisting of a random copolymer, a graft copolymer, a block copolymer and a group transfer polymer of said first monomer component(s) and said second monomer component(s).

3. The coating member according to claim 1, wherein said coating member further comprises a coupling agent component containing a vinyl group.

4. The coating member according to claim 3, wherein said coupling agent component is a silane coupling agent.

5. A charged member for electrostatic development which comprises a substrate and a coating layer which coats the substrate, wherein said coating layer comprises (i) a copolymer comprised of a first monomer component(s) represented by a general formula (1) and/or (2) below, a second monomer component(s) represented by a general formula (3) and/or (4) below and (ii) a coupling agent component containing a vinyl group:

(1)

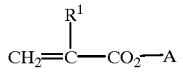

wherein $R^1$ is a hydrogen atom or a methyl group, A is $—(CH_2)_{n1}—NR^2R^3$ ($R^2$ and $R^3$ are an alkyl group, and an aryl group, and $n_1$ is an integer of 0 to 10);

(2)

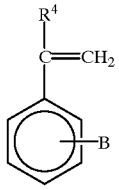

wherein $R^4$ is a hydrogen atom or a methyl group, B is $—(CH_2)_{n2}—NR^5R^6$ ($R^5$ and $R^6$ are an alkyl group, and an aryl group, and $n_2$ is an integer of 0 to 10);

(3)

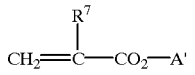

wherein $R^7$ is a hydrogen atom or a methyl group, A' is $—(CH_2)_{n3}—(CF_2)_m—CF_3$ or $—(CH)_{n3}—(CF_2)_m—(CF(CF_3)_2$
($n_3$ is an integer of 0 to 8, and m is an integer of 1 to 10); and (4)

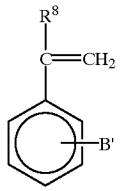

wherein $R^8$ is a hydrogen atom or a methyl group, B' is a fluorine atom, a trifluoromethyl group, $—Z—(CH_2)_{n3}—(CF_2)_m—CF_3$ or $—Z—(CH_2)_{n3}—(CF_2)_m—CF(CF_3)_2$
($n_3$ is an integer of 0 to 8, m is an integer of 1 to 10, and Z is an oxygen atom, a carbonyl group or an acid amide group).

6. The charged member for electrostatic development according to claim 5, wherein said coupling agent component is a silane coupling agent.

7. The charged member for electrostatic development according to claim 5, wherein said coating layer contains a polymer selected from the group consisting of random copolymer, graft copolymer, block copolymer and group transfer polymer of said first monomer component and said second monomer component.

8. The charged member for electrostatic development according to claim 7, wherein said substrate is a carrier core material and said charged member for electrostatic development is a carrier for electrophotography.

9. The charged member for electrostatic development according to claim 7, wherein said substrate is a conducting substrate and said charged member for electrostatic development is a sleeve for electrostatic development.

10. A carrier for electrophotography having a resin coating layer containing conductive powders on a core material, wherein said core material has a dynamic electrical resistance of not greater than 1 Ω cm under an electric field of $10^4$ V/cm in the state of a magnetic brush and the resin coating layer has an electrical resistance in the range of 10 to $1\times10^8$ Ω cm, and the resin is made up of a random copolymer, a block copolymer or a graft copolymer polymerized from a monomer represented by the general formula (I) and/or (II) below, and a monomer represented by the general formula (III) and/or (IV) below:

(I)

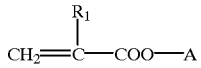

wherein $R_1$ represents a hydrogen atom or a methyl group, A represents $—(CH_2)_{n1}NR_2R_3$, $R_2$ and $R_3$ represent independently an alkyl group or an aryl group, and $n_1$ represents an integer of 0 to 10;

II

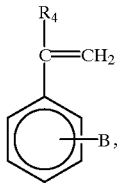

wherein $R_4$ represents a hydrogen atom or a methyl group, B represents $—(CH_2)_{n2}—NR_5R_6$, $R_5$ and $R_6$ represent independently an alkyl group or an aryl group, and $n_2$ represents an integer of 0 to 10;

(III)

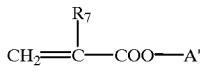

wherein $R_7$ represents a hydrogen atom or a methyl group, A' represents $—(CH_2)_{n2}—(CF_2)_m—CF_3$ or $—(CH_2)_{n3}—(CF_2)_m—CF(CF_3)_2$, $n_3$ represents an integer of 0 to 12, and m represents an integer of 1 to 12; and (IV)

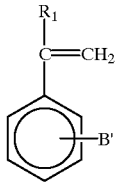

wherein $R_8$ represents a hydrogen atom or a methyl group, B' represents $—Z—(CH_2)_{n4}—(CF_2)_m—CF_3$ or $—Z—(CH_2)_{n4}—(CF_2)_m—CF(CF_3)_2$, $n_4$ represents an integer of 0 to 8, m represents an integer of 1 to 10, and Z represents an oxygen atom, a carbonyl or an acid amide.

11. The carrier for electrophotography according to claim 10, wherein the resin in the resin coating layer comprises a copolymer further copolymerizing the third monomer component represented by the following general formula (V) and/or (VI):

(V)

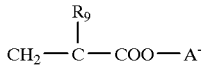

wherein $R_9$ represents a hydrogen or a methyl group, A" represents a hydrogen, alkyl group, cycloalkyl group, aryl group, allyl group, alkoxyalkylsilyl group or an epoxyalkyl group;

(VI)

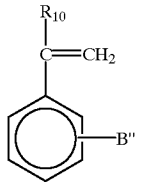

wherein $R_{10}$ represents a hydrogen or a methyl group, B" represents a hydrogen, alkyl group, cycloalkyl group or an aryl group.

12. The carrier for electrophotography according to claim 10, wherein the resin in the resin coating layer is a copolymer further copolymerizing a cross-linking monomer.

13. The carrier for electrophotography according to claim 10, wherein the thickness of the resin coating layer is 0.3 to 5 $\mu$m.

14. The carrier for electrophotography according to claim 10, wherein the volume average particle size of the core material is 10 to 100 $\mu$m.

15. The carrier for electrophotography according to claim 10, wherein the core material is ferrite.

16. The carrier for electrophotography according to claim 10, wherein the core material comprises magnetic powders dispersed in a thermoplastic or thermosetting resin.

17. The carrier for electrophotography according to claim 10, wherein the electrical resistance of the conducting powders is not greater than $10^6$ Ω cm.

18. The carrier for electrophotography according to claim 10, wherein the conducting powders comprise 2 to 40% volume based on the resin coating layer.

19. An electrostatic latent image developer having toner particles comprising a binding resin and a colorant, as well as the carrier for electrophotography according to claim 10.

20. The coating member according to claim 3, wherein the copolymer is further comprised of the coupling agent component containing a vinyl group.

21. The charged member according to claim 5, wherein the copolymer is further comprised of (ii) the coupling agent component containing a vinyl group.

* * * * *